US010463210B2

(12) United States Patent
Veros et al.

(10) Patent No.: US 10,463,210 B2
(45) **Date of Patent: *Nov. 5, 2019**

(54) TOILET NIGHT LIGHT

(71) Applicant: Delta Faucet Company, Indianapolis, IN (US)

(72) Inventors: Michael J. Veros, Carmel, IN (US); Gary Jacobs, Indianapolis, IN (US); DeWayne Davis, Lebanon, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/033,879

(22) Filed: Jul. 12, 2018

(65) Prior Publication Data

US 2018/0317722 A1 Nov. 8, 2018

Related U.S. Application Data

(62) Division of application No. 14/730,962, filed on Jun. 4, 2015, now Pat. No. 10,039,427.

(60) Provisional application No. 62/009,718, filed on Jun. 9, 2014.

(51) Int. Cl.

| | |
|---|---|
| ***A47K 13/24*** | (2006.01) |
| ***F21S 8/00*** | (2006.01) |
| ***F21S 9/02*** | (2006.01) |
| ***F21V 21/108*** | (2006.01) |
| ***F21V 23/00*** | (2015.01) |
| ***F21V 33/00*** | (2006.01) |
| *F21W 131/30* | (2006.01) |
| *F21Y 115/10* | (2016.01) |

(52) U.S. Cl.

CPC ..... *A47K 13/24* (2013.01); *F21S 8/03* (2013.01); *F21S 9/02* (2013.01); *F21V 21/108* (2013.01); *F21V 23/005* (2013.01); *F21V 33/004* (2013.01); *F21W 2131/30* (2013.01); *F21Y 2115/10* (2016.08)

(58) Field of Classification Search

CPC ..... A47K 17/00; A47K 13/24; F21S 8/03
USPC ..... 4/661, 237
See application file for complete search history.

(56) References Cited

U.S. PATENT DOCUMENTS

| | | | | |
|---|---|---|---|---|
| 4,331,355 | A | 5/1982 | Okuno | |
| 4,413,364 | A | 11/1983 | Bittaker et al. | |
| 4,860,178 | A | 8/1989 | Picon | |
| 5,036,443 | A | 7/1991 | Humble et al. | |
| 5,276,595 | A | 1/1994 | Patric | |
| 5,437,066 | A | 8/1995 | Mills et al. | |
| 5,611,089 | A | 3/1997 | Cretors | |
| 5,664,867 | A | 9/1997 | Martin et al. | |
| 5,748,096 | A | 5/1998 | Kaufer | |
| 5,896,600 | A | 4/1999 | Mills et al. | |
| 7,036,158 | B2 | 5/2006 | Bradford et al. | |
| 8,024,821 | B2 | 9/2011 | Chen | |
| 8,398,257 | B1 | 3/2013 | Paulus | |
| 9,380,918 | B2 | 7/2016 | Murphy | |
| 10,039,427 | B2 * | 8/2018 | Veros | A47K 13/24 |
| 2004/0226082 | A1 | 11/2004 | Squicciarini | |

(Continued)

FOREIGN PATENT DOCUMENTS

| | | | |
|---|---|---|---|
| CN | 203122270 | U | 8/2013 |

*Primary Examiner* — Tuan N Nguyen
(74) *Attorney, Agent, or Firm* — Faegre Baker Daniels LLP

(57) ABSTRACT

A night light supported by a toilet seat assembly for directing illumination toward a toilet bowl.

15 Claims, 31 Drawing Sheets

(56) References Cited

U.S. PATENT DOCUMENTS

| | | | |
|---|---|---|---|
| 2005/0071917 | A1 | 4/2005 | Landon |
| 2006/0042004 | A1 | 3/2006 | Prueitt Busch |
| 2007/0256222 | A1 | 11/2007 | Olshausen |
| 2007/0294821 | A1 | 12/2007 | Griner |
| 2008/0271231 | A1 | 11/2008 | Stauber et al. |
| 2009/0185367 | A1 | 7/2009 | Moore |
| 2010/0313341 | A1 | 12/2010 | Jordan |
| 2011/0133648 | A1 | 6/2011 | Melton |
| 2011/0267201 | A1 | 11/2011 | Bucha |
| 2012/0023651 | A1 | 2/2012 | Taylor et al. |
| 2012/0068613 | A1 | 3/2012 | Veneto |
| 2012/0144569 | A1 | 6/2012 | Kodat |
| 2012/0180206 | A1 | 7/2012 | Leonida |
| 2012/0235578 | A1 | 9/2012 | Miller |
| 2014/0047629 | A1 | 2/2014 | Stauber et al. |

* cited by examiner

TOILET NIGHT LIGHT

CROSS-REFERENCE TO RELATED APPLICATION

This application is a continuation application of U.S. patent application Ser. No. 14/730,962, filed Jun. 4, 2015, which claims priority to U.S. Provisional Patent Application Ser. No. 62/009,718, filed Jun. 9, 2014, the disclosures of which are expressly incorporated herein by reference.

BACKGROUND AND SUMMARY

The present invention relates to toilets and, more particularly, to a night light supported by a toilet seat assembly and configured to direct light into a toilet bowl.

It is known to provide a toilet seat assembly including a battery powered night light to illuminate a bowl area. Such night lights may be included within toilet lids, toilet seats and/or toilet seat hinges, and may be activated in response to a variety of different inputs, such as an ambient light sensor, a timer and/or a sensor for detecting toilet seat position (e.g., raised and lowered).

It is desired to provide a toilet night light that provides adequate lighting of a toilet bowl when the seat is in both a raised position and a lowered position. It is further desired to provide such a toilet night light with easily accessible and replaceable batteries positioned in an area of reduced potential contamination. Finally, it is desired to provide such a night light that is easy to clean by reducing potential debris collection points.

According to an illustrative embodiment of the present disclosure, a light assembly for illuminating a toilet bowl includes a receiving chamber supported above a toilet bowl, a holder received within the receiving chamber, and a plurality of batteries received within the holder. A light source is in electrical communication with the plurality of batteries. A cover is supported adjacent to the light source. A coupler releasably secures the holder within the receiving chamber in a secured mode, and permits removal of the holder from the receiving chamber in a released mode.

In a further illustrative embodiment of the present disclosure, a light assembly for illuminating a toilet bowl includes a toilet seat including an upper surface, a lower surface, an inner surface and an outer surface. The toilet seat further includes a receiving chamber extending along a longitudinal chamber axis and including an opening within the outer surface. A hinge couples the toilet seat to the toilet bowl for pivoting movement of the toilet seat about a pivot axis between a raised position and a lowered position. The pivot axis extends parallel to the chamber axis and is positioned rearward of the chamber axis when the seat is in the lowered position. A holder is received within the receiving chamber. A plurality of batteries are received within the holder. A light source is in electrical communication with the plurality of batteries. A coupler releasably secures the holder within the receiving chamber in a secured mode, and permits removal of the holder from the receiving chamber in a released mode.

According to another illustrative embodiment of the present disclosure, a light assembly includes a toilet seat, and a hinge coupling the toilet seat to a toilet bowl for pivoting movement of the toilet seat about a pivot axis. The hinge includes a housing defining a front chamber positioned forward of the pivot axis, and a rear chamber positioned rearward of the front chamber. A light source is received within the front chamber and is positioned to overhang the rim of the toilet bowl to direct light into the toilet bowl. At least one battery is received within the rear chamber and is in electrical communication with the light source.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
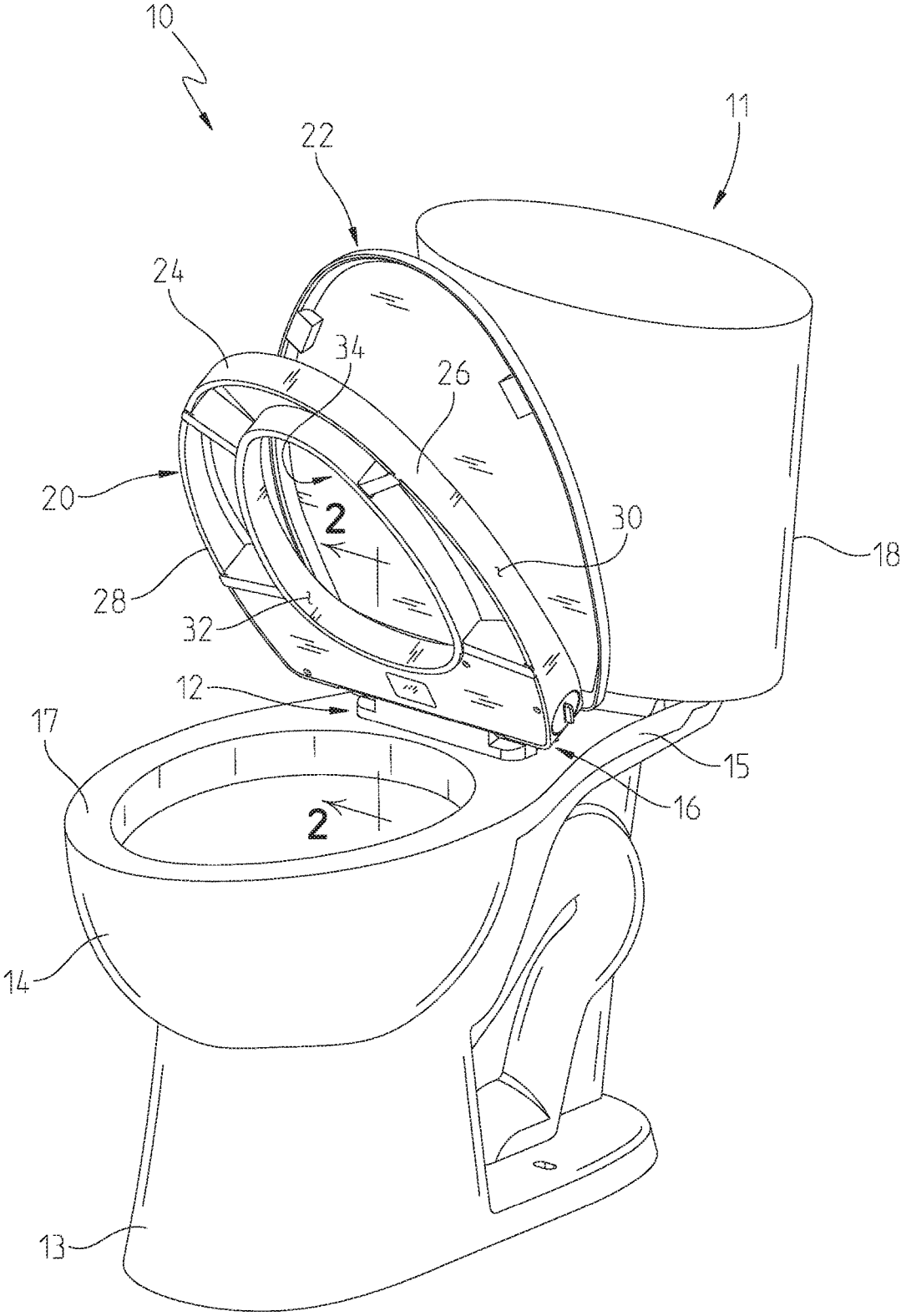
FIG. 1 is a perspective view of a toilet supporting an illustrative toilet seat assembly, the toilet seat assembly including a night light.

With reference initially to FIG. 1, an illustrative toilet seat assembly 10 is shown coupled to a toilet 11. The toilet seat assembly 10 includes a night light 12 according to an illustrative embodiment of the present disclosure. The toilet 11 may be of conventional design as including a stool 13 including a toilet bowl 14 and a shelf 15. A toilet tank 18 is supported by the toilet bowl 14 and is fluidly coupled thereto in a conventional manner.

Figure 7:
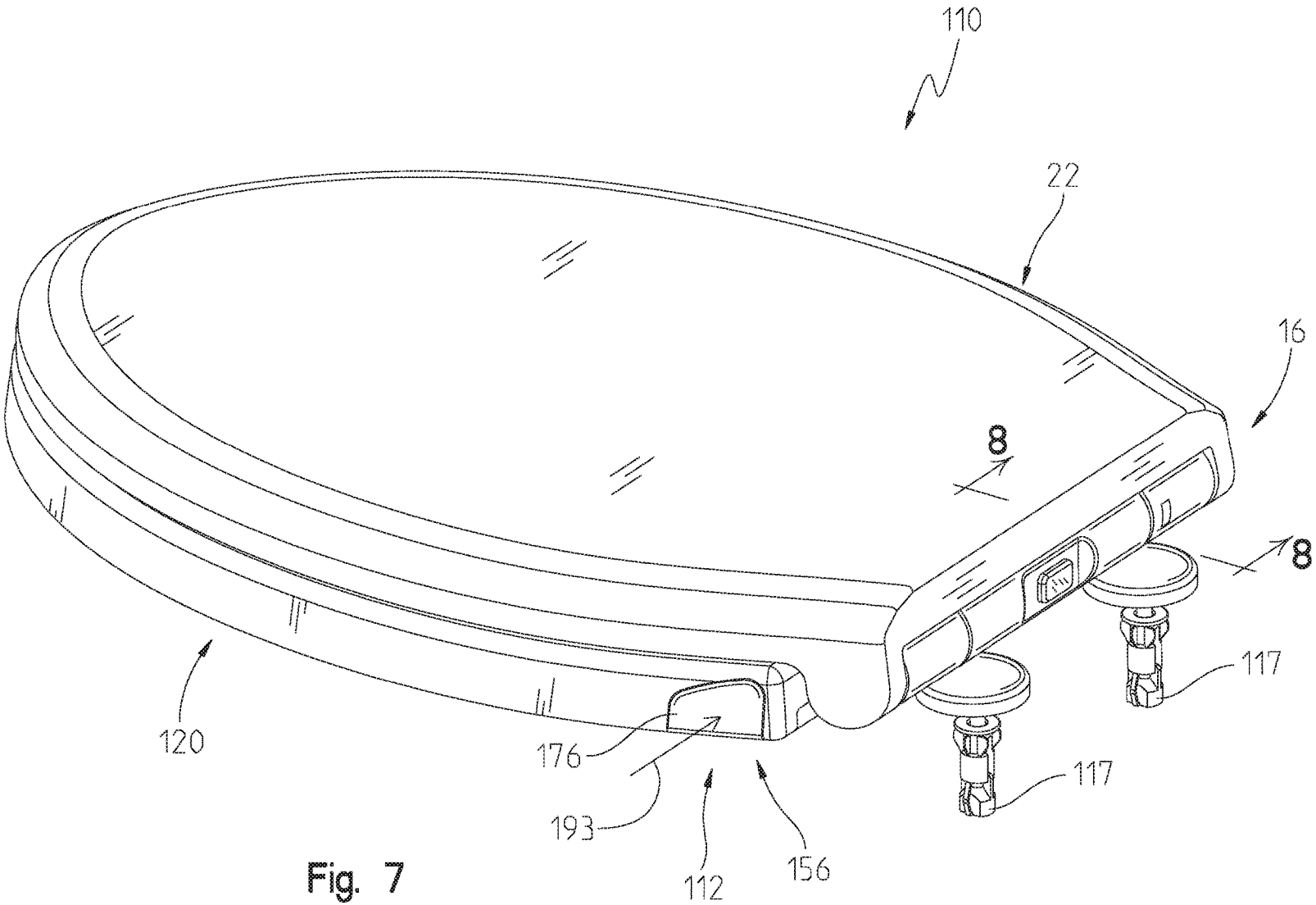
FIG. 7 is a perspective view of a further illustrative toilet seat assembly, the toilet seat assembly including a night light.

The toilet seat assembly 10 is illustratively coupled to the toilet bowl 14 through a hinge assembly 16. The hinge assembly 16 may include conventional anchors (such as anchors 117 shown in FIG. 7) received within the shelf 15 of the toilet bowl 14. The toilet bowl 14 includes an upper rim 17 for supporting the toilet seat assembly 10.

The toilet seat assembly 10 illustratively includes a seat 20 and a lid or cover 22, both pivotably coupled to the toilet bowl 14 through the hinge assembly 16. Both the seat 20 and the cover 22 may be formed of an opaque polymer. The seat 20 illustratively includes a body or ring 24 including an upper surface 26, a lower surface 28, an outer surface 30 and an inner surface 32. The inner surface 32 illustratively defines an opening 34.

Figure 2A:
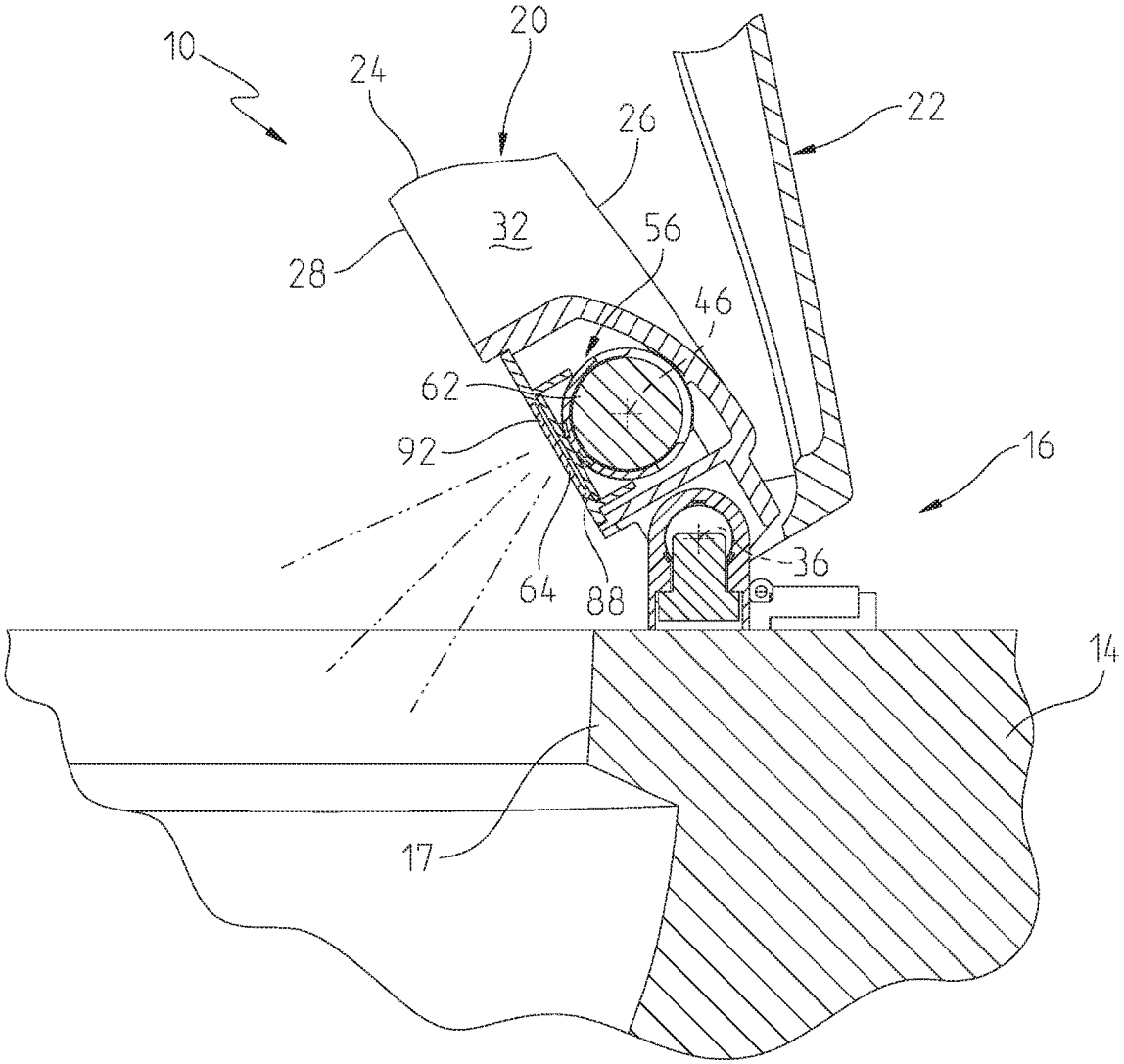
FIG. 2A is a cross-sectional view taken along line 2-2 of FIG. 1, with the toilet seat shown in an intermediate position.
Figure 2B:
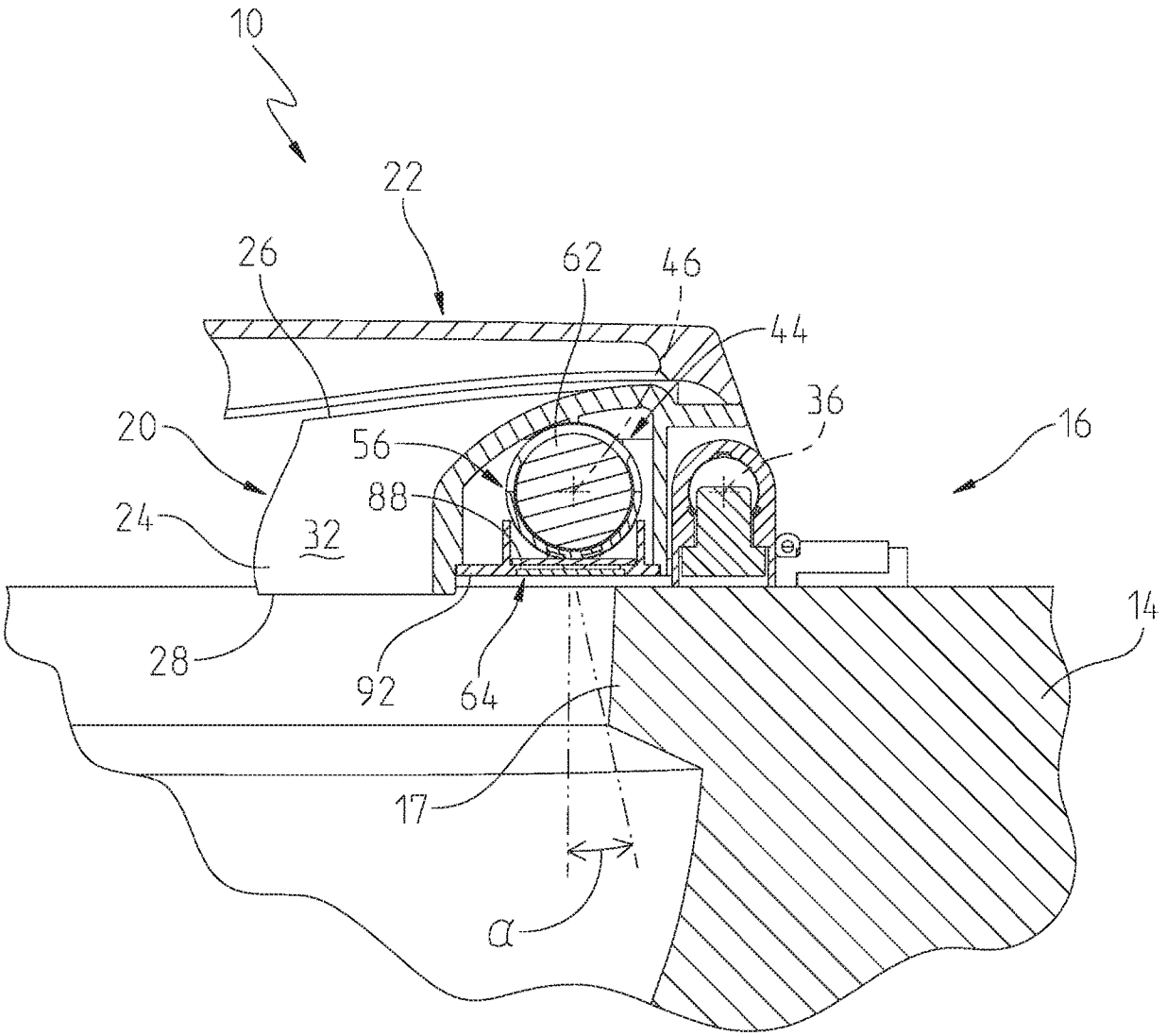
FIG. 2B is a cross-sectional view similar to FIG. 2A, with the toilet seat shown in a fully lowered position.
Figure 2C:
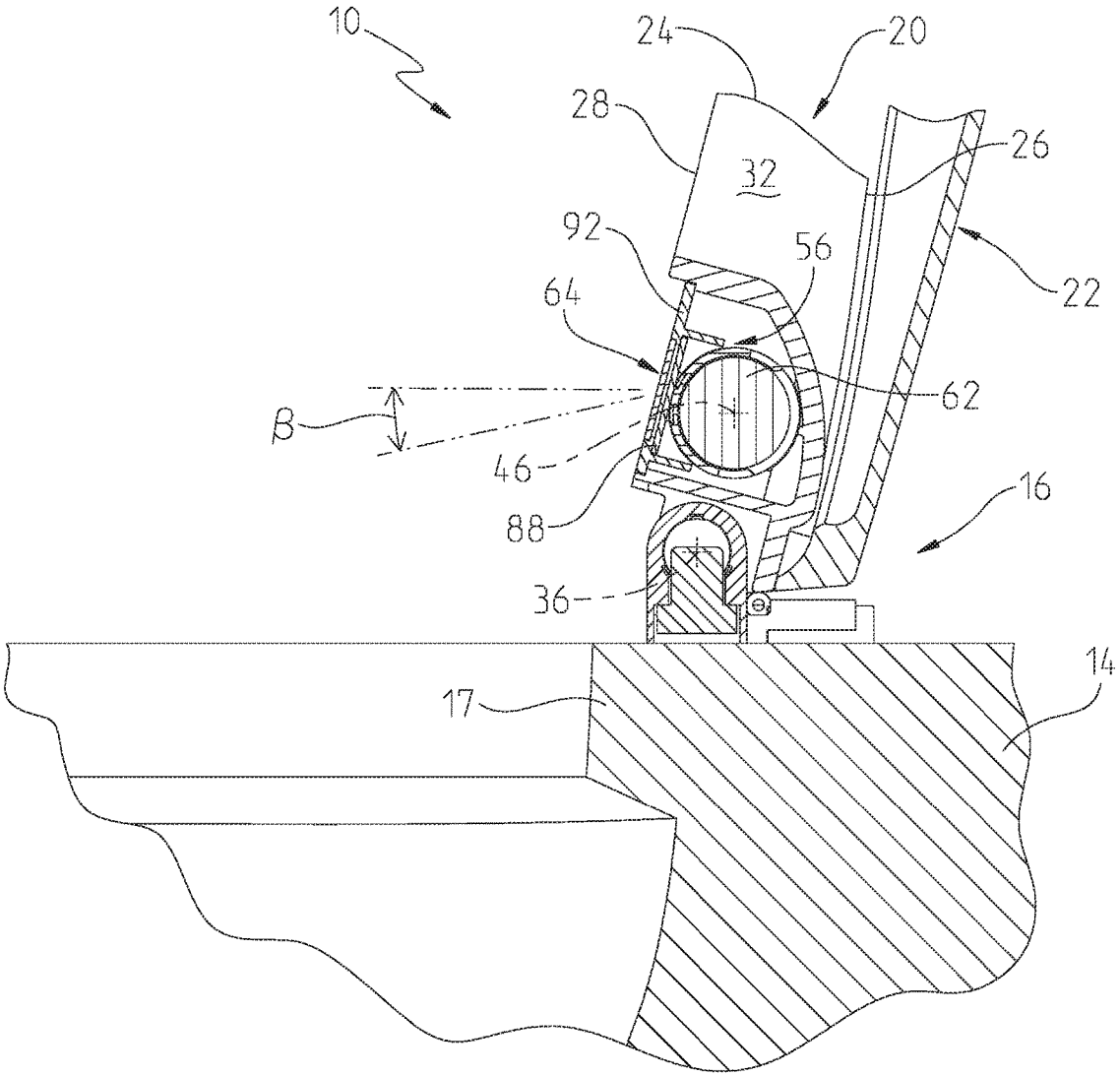
FIG. 2C is a cross-sectional view similar to FIG. 2A, with the toilet seat shown in a fully raised position.
Figure 3:
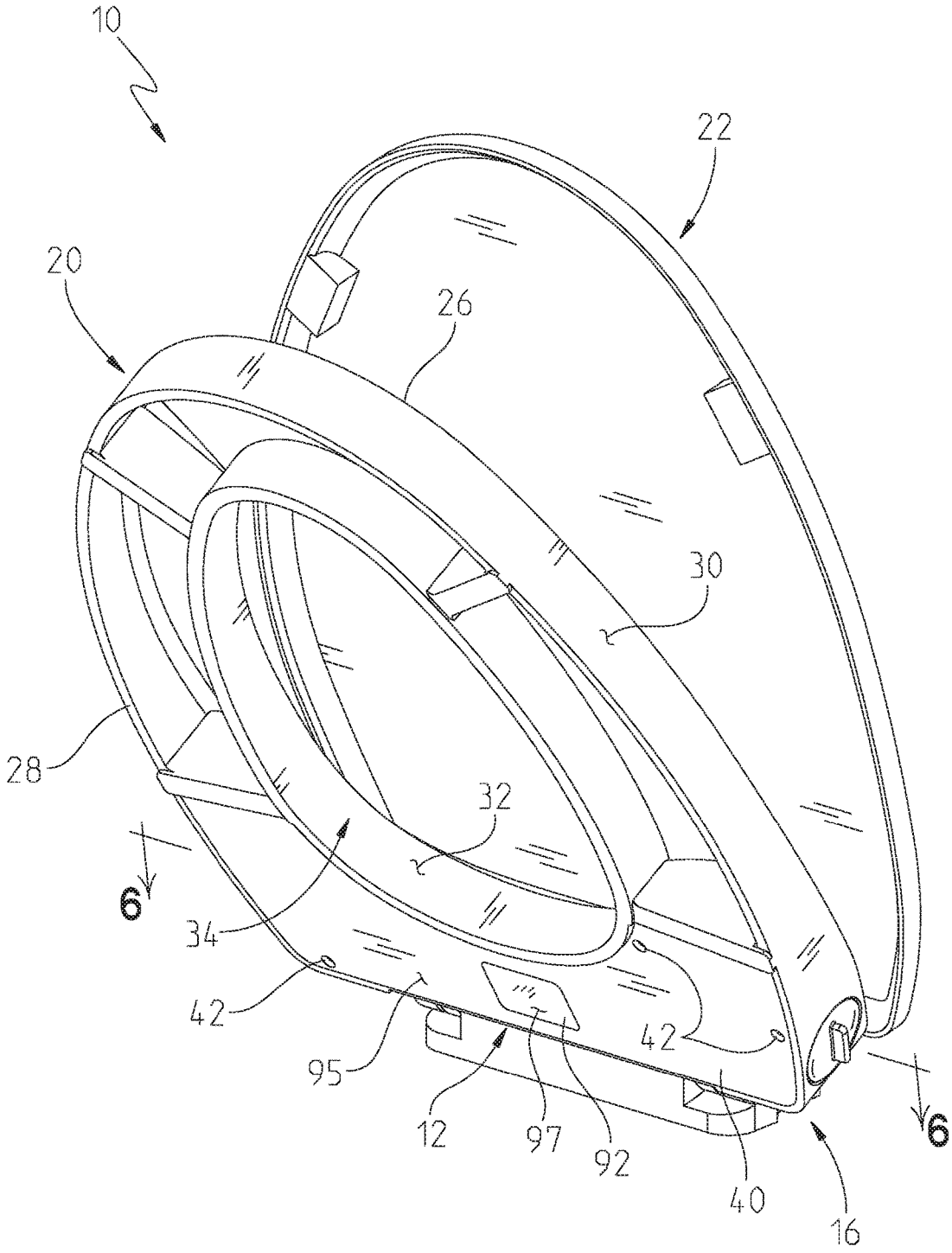
FIG. 3 is a perspective view of the toilet seat assembly of FIG. 1, the toilet seat assembly including a night light.
Figure 4:
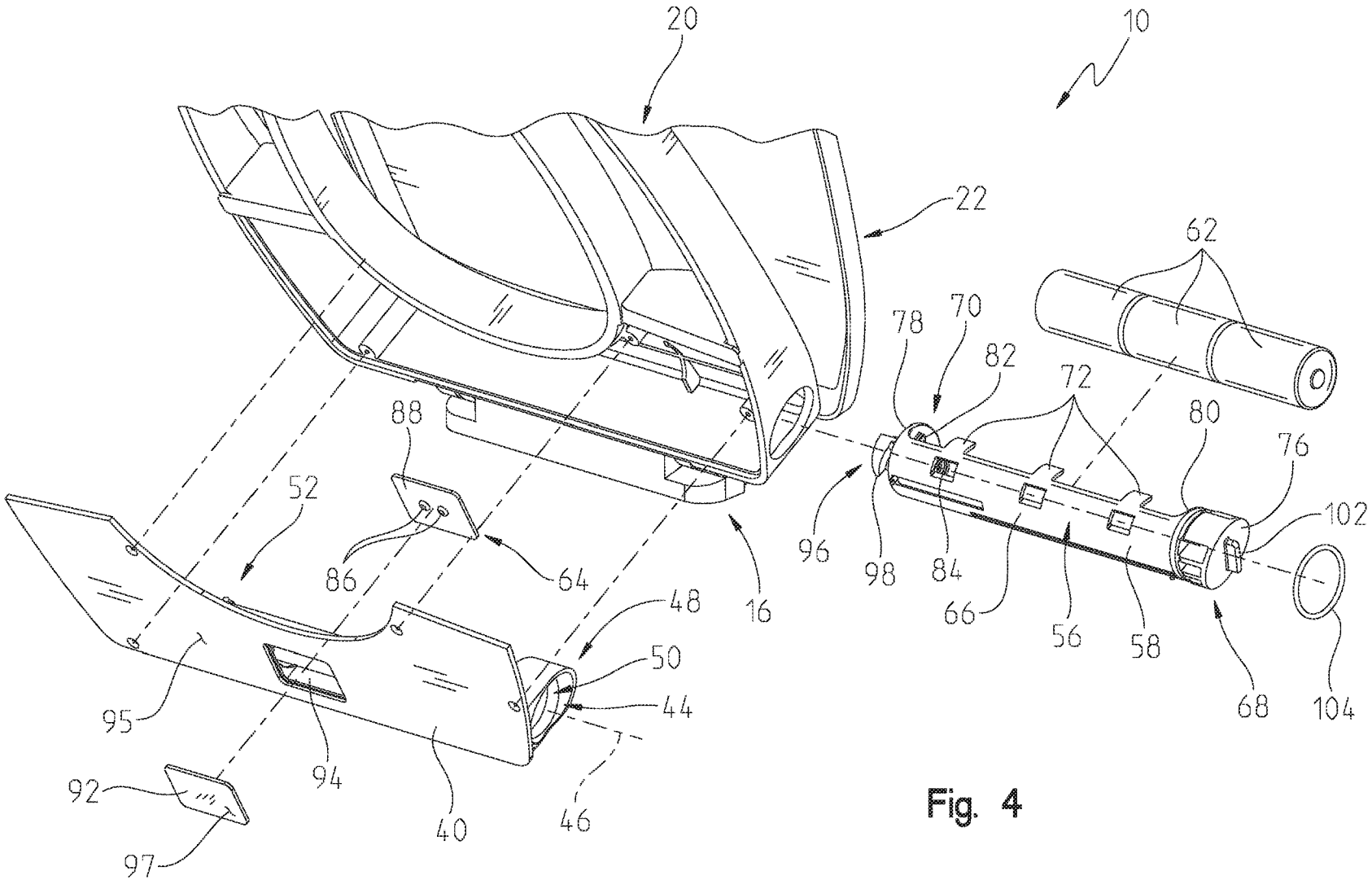
FIG. 4 is a partially exploded front perspective view of the toilet seat assembly of FIG. 3.

The hinge assembly 16 may be of conventional design for supporting the seat 20 for pivoting movement about a pivot axis 36. The seat 20 may be moved between a fully lowered position (substantially horizontal as shown in FIG. 2B) and a fully raised position (substantially vertical as shown in FIG. 2C). The lid 22 may also be moved between raised and lowered positions, wherein the opening 34 defined by the seat 20 may be selectively covered by the lid 22 when in the lowered position.

With reference to FIGS. 2B and 3-6, the illustrative night light 12 is coupled to the underside of the seat 20 at a rearward position (i.e., proximate the hinge assembly 16). A receiver 40 is secured to the seat 20 through conventional means, such as screws 42. Alternatively, the receiver 40 may be molded from a polymer with the seat 20, attached though adhesives or secured through ultrasonic welding. When coupled to the seat 20, the receiver 40 includes a receiving chamber 44 defining a chamber axis 46 extending parallel to the pivot axis 36 of the hinge assembly 16 (FIGS. 2A-2C). When the seat 20 is in the lowered position (FIG. 2B), the pivot axis 36 is positioned rearward of the chamber axis 46. A first or proximal end 48 of the chamber 44 includes an access opening 50 formed within the outer surface 30 of the seat 20. A second or distal end 52 of the chamber 44 includes a coupler 54 configured to releasably secure a holder 56 within the chamber 44.

Figure 5:
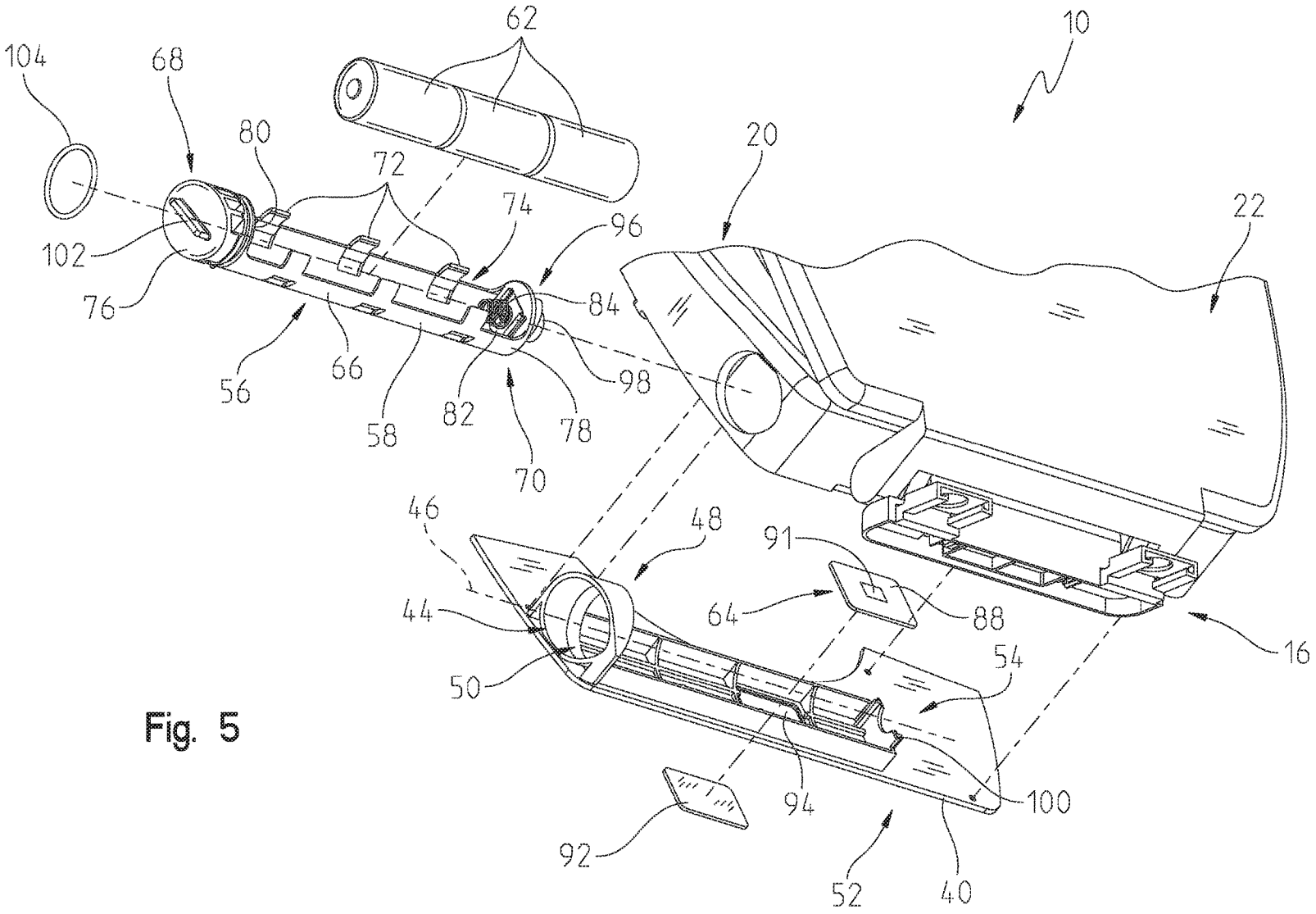
FIG. 5 is a partially exploded rear perspective view of the toilet seat assembly of FIG. 3.
Figure 6:
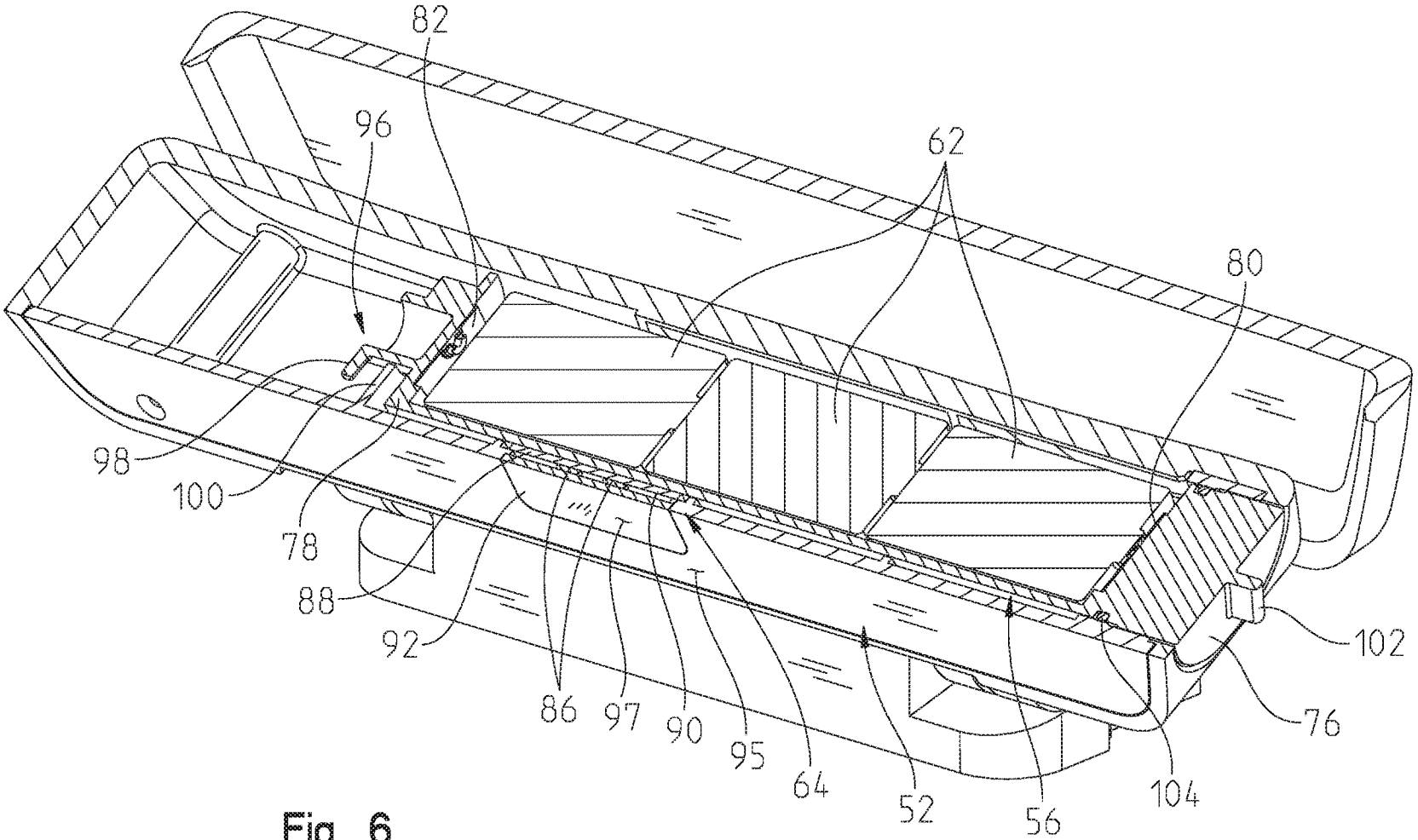
FIG. 6 is a cross-sectional view taken along line 6-6 of FIG. 3.

The holder 56 illustratively includes a body 58, such as a substantially cylindrical sleeve, holding a plurality of batteries 62 (e.g., a plurality of c-cell batteries). A light source 64 is in electrical communication with the plurality of batteries 62. The holder body 58 illustratively includes a semi-cylindrical base 66 extending between a proximal end 68 and a distal end 70. Flexible tabs 72 are illustratively supported by the base 66. The flexible tabs 72 may be arcuate and define a longitudinally extending slot 74 to receive and retain the batteries 62. End walls or discs 76 and 78 are supported at opposing ends 68 and 70 of the body 58. A proximal electrical contact 80 is supported by the end wall 76, and a distal electrical contact 82 is supported by the end wall 78. Distal electrical contact 82 may include a spring 84 (FIG. 5).

The light source 64 illustratively comprises light emitting diodes (LEDs) 86 supported on a circuit board 88. Electrical contacts 80, 82 illustratively provide electrical communication between the batteries 62 and the light source 64 through electrical traces (not shown) on the circuit board 88. A controller 91 (FIG. 5), such as a microprocessor, may be supported on the circuit board 88 for receiving input from sensors and/or user interfaces to control operation of the LEDs 86. The LEDs 86 may be configured to transmit light of the same color (e.g., blue) or different colors (e.g., blue, amber and/or red). The LEDs 86 may be in electrical communication with an operating system or controller of the toilet 11 to provide a status indication (e.g., flush activation, overflow warning, low water indicator, etc.).

In certain illustrative embodiments, the circuit board 88 and the LEDs 86 are integrated within the holder 56. This allows for a static electrical connection between the batteries 62 and the circuit board 88. In such embodiments, mating alignment features may be provided between the receiver 40 and the holder 56 to facilitate proper angular orientation of the circuit board 88 and LEDs 86 relative to the toilet bowl 14.

The light source 64 is illustratively positioned to overhang the rim 17 of the toilet bowl 14. In certain illustrative embodiments, the LEDs 86 may be angled rearwardly from vertical (angle $\alpha$) when the seat 20 is in the lowered position (FIG. 2B), and may be angled downwardly from horizontal (angle $\beta$) when the seat 20 is in the raised position (FIG. 2C). As such, the light source 64 is configured to direct light into the toilet bowl 14 for illumination in all positions of the toilet seat 20 (e.g., FIGS. 2A, 2B and 2C). In one illustrative embodiment, angle $\alpha$ is approximately 30 degrees, and angle $\beta$ is approximately 15 degrees.

A cover or window 92 is supported within a lower surface of the seat 20 adjacent to the light source 64. The cover 92 is illustratively formed of a polymer and translucent (i.e., allowing the passage of light from the light source 64). In certain illustrative embodiments the cover 92 is clear or transparent, while in other illustrative embodiments the cover 92 acts as a light diffuser. The cover 92 is illustratively supported within an opening 94 formed within the receiver 40. The cover 92 may be secured in place through conventional means, such as an adhesive. In illustrative embodiments, the cover 92 may be overmolded or insert molded within the seat 20 to eliminate seams and thereby reduce potential contamination areas. More particularly, a smooth transition is illustratively provided between the lower surface 95 of the opaque seat 20 (as defined by the receiver 40) and the lower surface 97 of the translucent cover 92.

In the illustrative embodiment, the coupler 54 comprises a cam lock 96 including a tab 98 supported at distal end 70 of the holder 56 and configured to engage with a wall 100 supported within the receiving chamber 44. The tab 98 is rotatable with the proximal end 68 of the holder 56 from a first position where the holder 56 is in a released mode, to a second position where the holder 56 is in a secured mode. In the released mode, the tab 98 is disengaged from the wall 100 to permit axial movement of the holder 56 outwardly from the receiving chamber 44. In secured mode, the tab 98 engages the wall 100 to prevent axial movement of the holder 56 within the receiving chamber 44. A handle 102 is supported by the proximal end 68 of the holder 56 and is configured to facilitate user rotation of the holder 56. An o-ring 104 is illustratively supported at the proximal end 68 of the holder 56 and is configured to seal the receiving chamber 44 from fluid.

In operation, the light source 64 may be activated through a variety of means. For example, the holder 56 may support a switch (not shown) that when depressed by a user starts a timer incorporated within the controller 91. In an alternative embodiment, the timer may be activated when the batteries 62 provide initial power to the circuit board 88 (e.g., when the batteries 62 are installed or re-installed). The timer is illustratively configured to activate the light source 64 for a predetermined duration (e.g., 8 hours) starting at the same time during each 24 hour time period. In other words, the light source 64 is active for 8 hours and inactive for 16 hours at the same time each day. A user interface (e.g., a switch or dial) may be provided so that a user may change the start time and/or duration of activation of light source 64.

In alternative embodiments, the light source 64 may be activated when the seat 20 is pivoted between raised and lowered positions (FIGS. 2C and 2B, respectively) in response to a position switch (not shown) operably coupled to the seat 20 and in communication with the controller 91. In certain illustrative embodiments, the light source 64 may be activated only when the seat 20 is in the raised position, or the light source 64 may have different intensities or angular orientations of light depending upon whether the seat is in the raised position or the lowered position.

A motion sensor (not shown) may be provided in communication with the controller 91 to activate the light source 64 in response to detecting a person moving near the toilet 11. A proximity sensor (not shown) may also be provided in communication with the controller 91 to activate the light source 64 in response to detecting a person in proximity to the toilet 11.

In yet other alternative embodiments, the light source 64 may be activated when ambient light below a predetermined threshold is detected by a light sensor (not shown), which is in electrical communication with the controller 91. Alternatively, an acoustical sensor (not shown) may be in communication with the controller 91 to activate the light source 64 in response to detected sound.

With reference now to FIGS. 7-17, a further illustrative embodiment night light 112 for use with toilet seat assembly 110 is illustrated. The night light 112 and toilet seat assembly 110 include many of the same components identified above with night light 12 and toilet seat assembly 10. As such, similar components will be identified with like reference numbers.

The toilet seat assembly 110 includes a toilet seat 120 illustratively having an upper seat ring 122 and a lower seat base or bottom cover 124. Conventional fasteners, such as screws 126, may couple the upper seat ring 122 to the bottom cover 124. Alternatively, the upper seat ring 122 and the bottom cover 124 may be molded together from a polymer, attached though adhesives or secured through ultrasonic welding.

Hinge assembly 16 may be of conventional design for supporting the seat 120 and the lid 22 for pivoting movement about pivot axis 36. Illustratively, conventional mounting anchors 117 to secure the hinge assembly 16 to the stool 13, illustratively the bowl 14 or the shelf 15, of the toilet 11.

Figure 8:
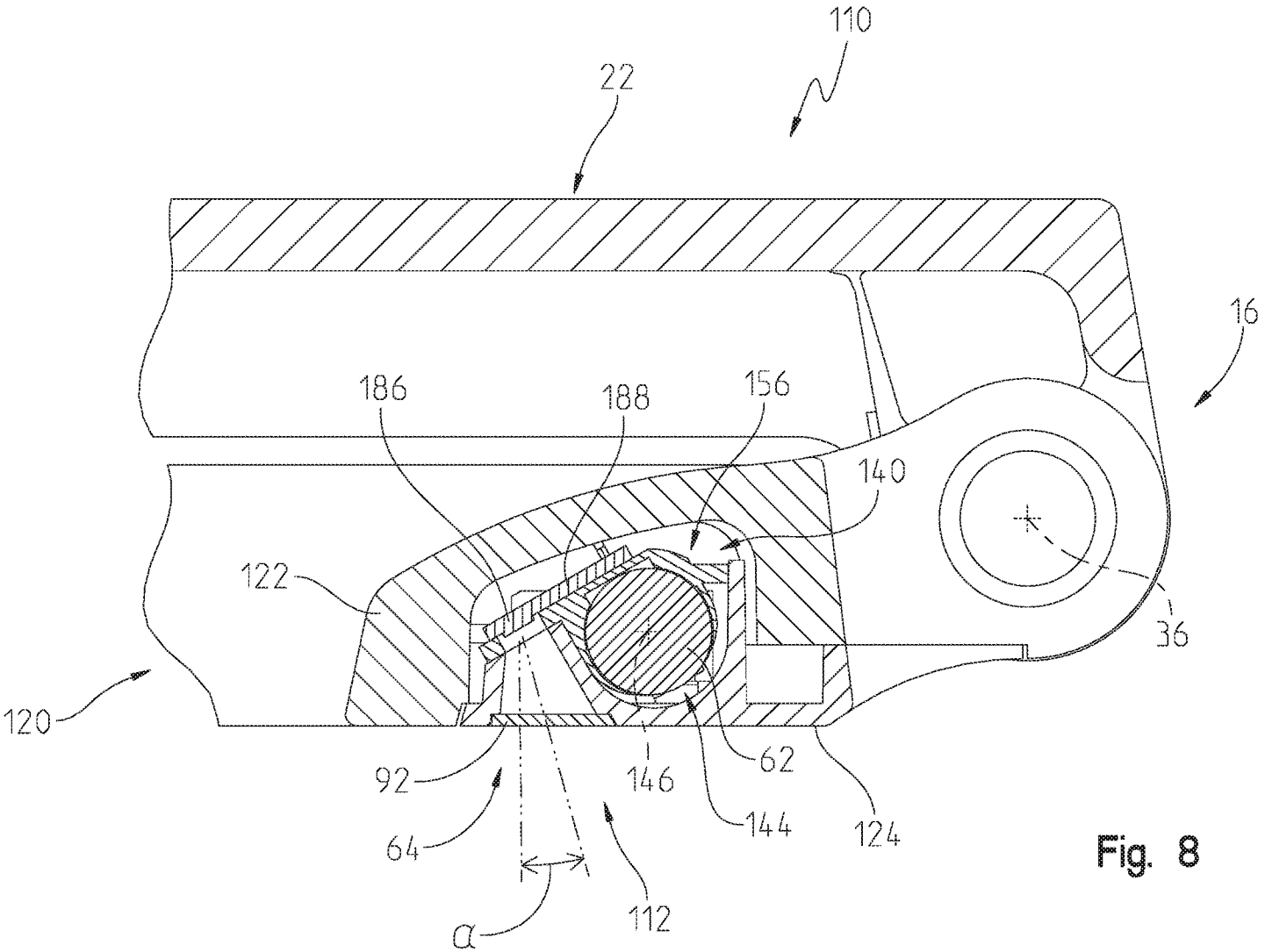
FIG. 8 is a cross-sectional view taken along line 8-8 of FIG. 7.
Figure 9:
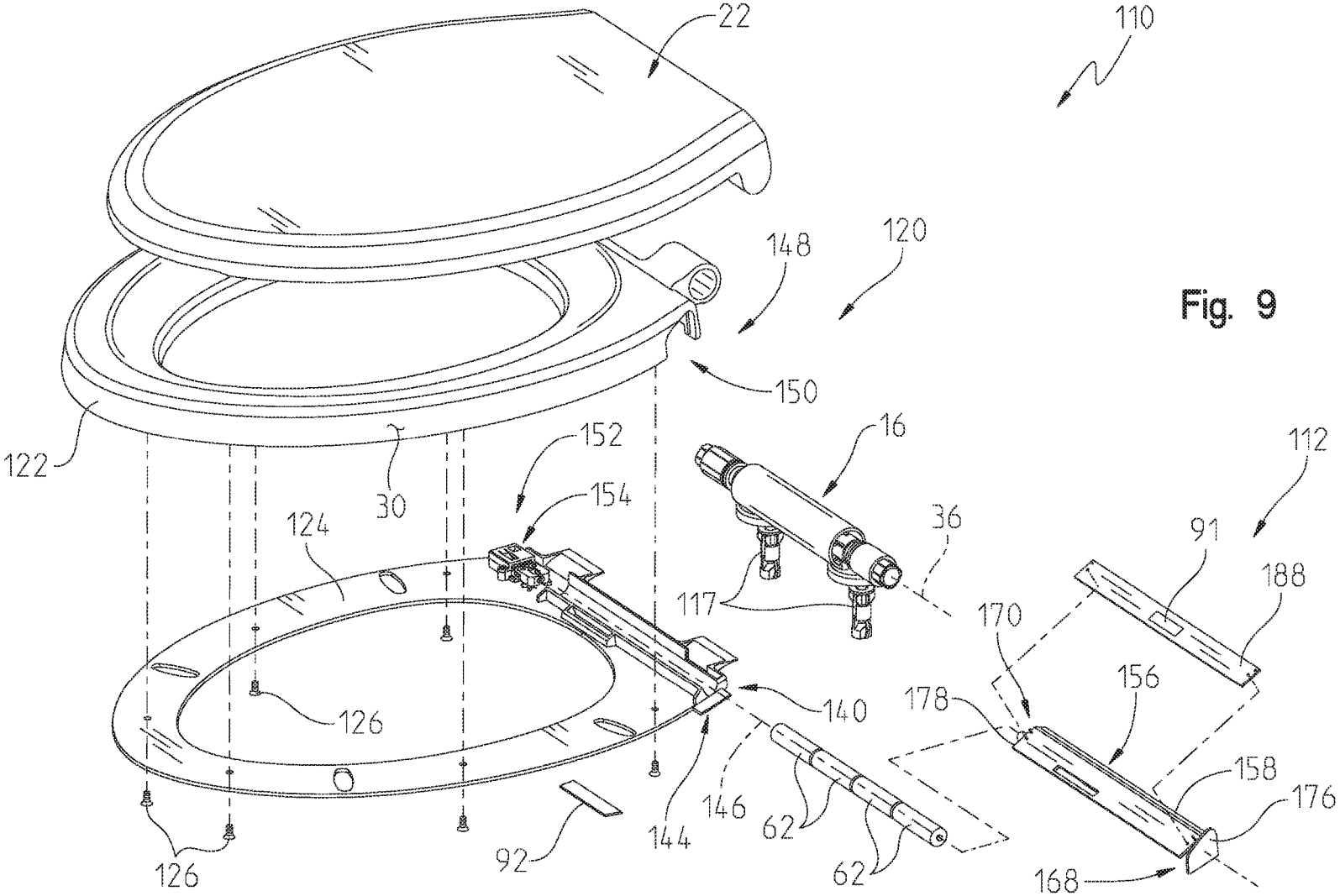
FIG. 9 is a partially exploded front perspective view of the toilet seat assembly of FIG. 7.

A receiver 140 is defined within the seat 120 between the upper seat ring 122 and the bottom cover 124. Illustratively, the receiver 140 is molded within the upper seat ring 122 and/or the bottom cover 124. As detailed above, the receiver 140 includes a receiving chamber 144 defining a chamber axis 146 extending parallel to the pivot axis 36 of the hinge assembly 16 (FIG. 8). A proximal end 148 of the chamber 144 includes an access opening 150 formed within the outer surface 30 of the seat 120. A distal end 152 of the chamber 144 includes a coupler 154 configured to releasably secure a holder 156 within the chamber 144.

Figure 10:
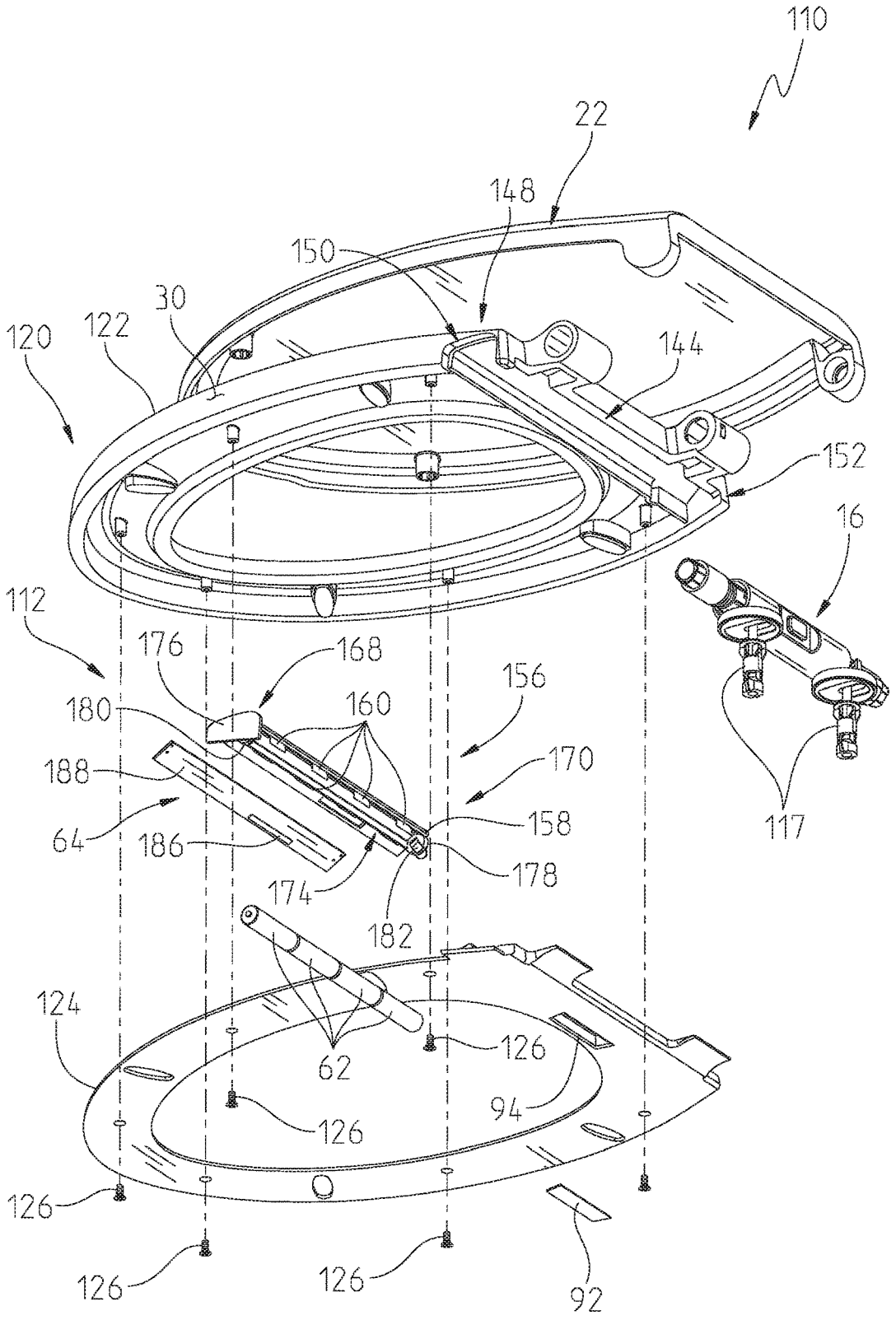
FIG. 10 is a partially exploded rear perspective view of the toilet seat assembly of FIG. 7.

The holder 156 illustratively includes a body 158 supporting a plurality of flexible tabs or arms 160 holding batteries 62 (e.g., a plurality of c-cell batteries). The flexible tabs 160 may be arcuate and define a longitudinally extending slot 174 to receive and retain the batteries 62. End walls 176 and 178 are supported at opposing proximal and distal ends 168 and 170 of the body 158. A proximal electrical contact 180 is supported by the end wall 176, and a distal electrical contact 182 is supported by the end wall 178 (FIG. 10).

The light source 64 illustratively comprises a light emitting diode (LED) 186 supported on a circuit board 188. A static electrical connection is provided between the batteries 62 and the light source 64. A controller 91 (FIG. 9), such as a microprocessor, may be supported on the circuit board 188.

As with the night light 12, the light source 64 of night light 112 is illustratively positioned to overhang the rim 17 of the toilet bowl 14. In certain illustrative embodiments, the light source 64 may be positioned to direct light perpendicular to the seat 120, such that light is directed vertically downwardly when the seat 120 is in the fully lowered position.

In other illustrative embodiments, the light source 64 may be angled rearwardly from vertical when the seat 120 is in the fully lowered position, and may be angled downwardly from horizontal when the seat 120 is in the fully raised position. As such, the light source 64 is configured to illuminate the toilet bowl 14 in all positions of the toilet seat 120. In one illustrative embodiment, the LED 186 may be angled rearwardly from vertical (angle $\alpha$) when the seat 120 is in the fully lowered position (FIG. 8), and may be angled downwardly from horizontal when the seat 20 is in the fully raised position. In one illustrative embodiment, angle $\alpha$ is approximately 30 degrees. As such, the light source 64 is configured to direct light into the toilet bowl 14 for illumination in all positions of the toilet seat 20.

The night light 112 illustratively includes a coupler 154 having a push lock 190 to releasably secure distal end 170 of the holder 156. Other couplers may be substituted therefor, such as a cam lock, snap fingers, etc.

Figure 11:
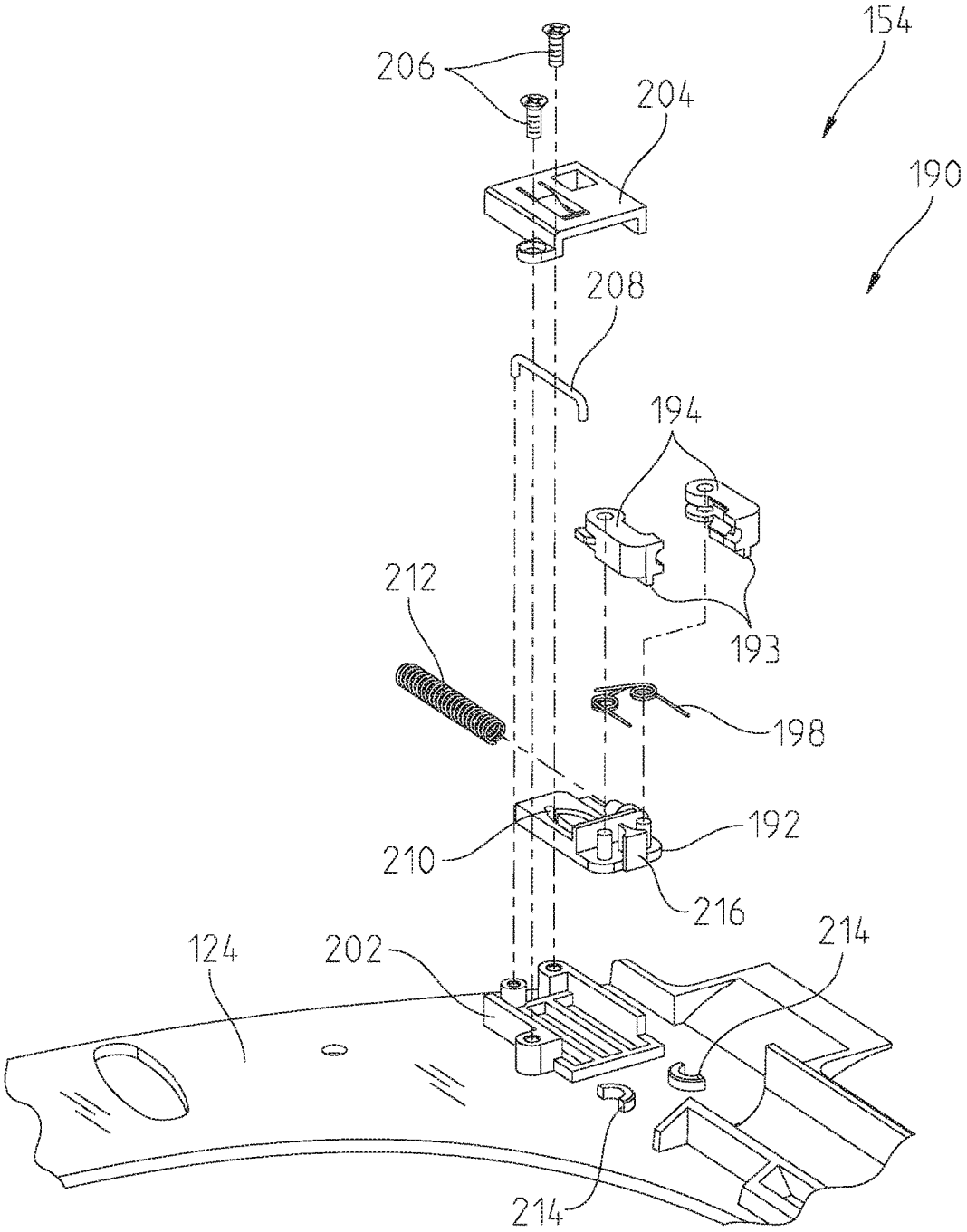
FIG. 11 is an exploded perspective view of the coupler of the toilet seat assembly of FIG. 7.
Figure 12:
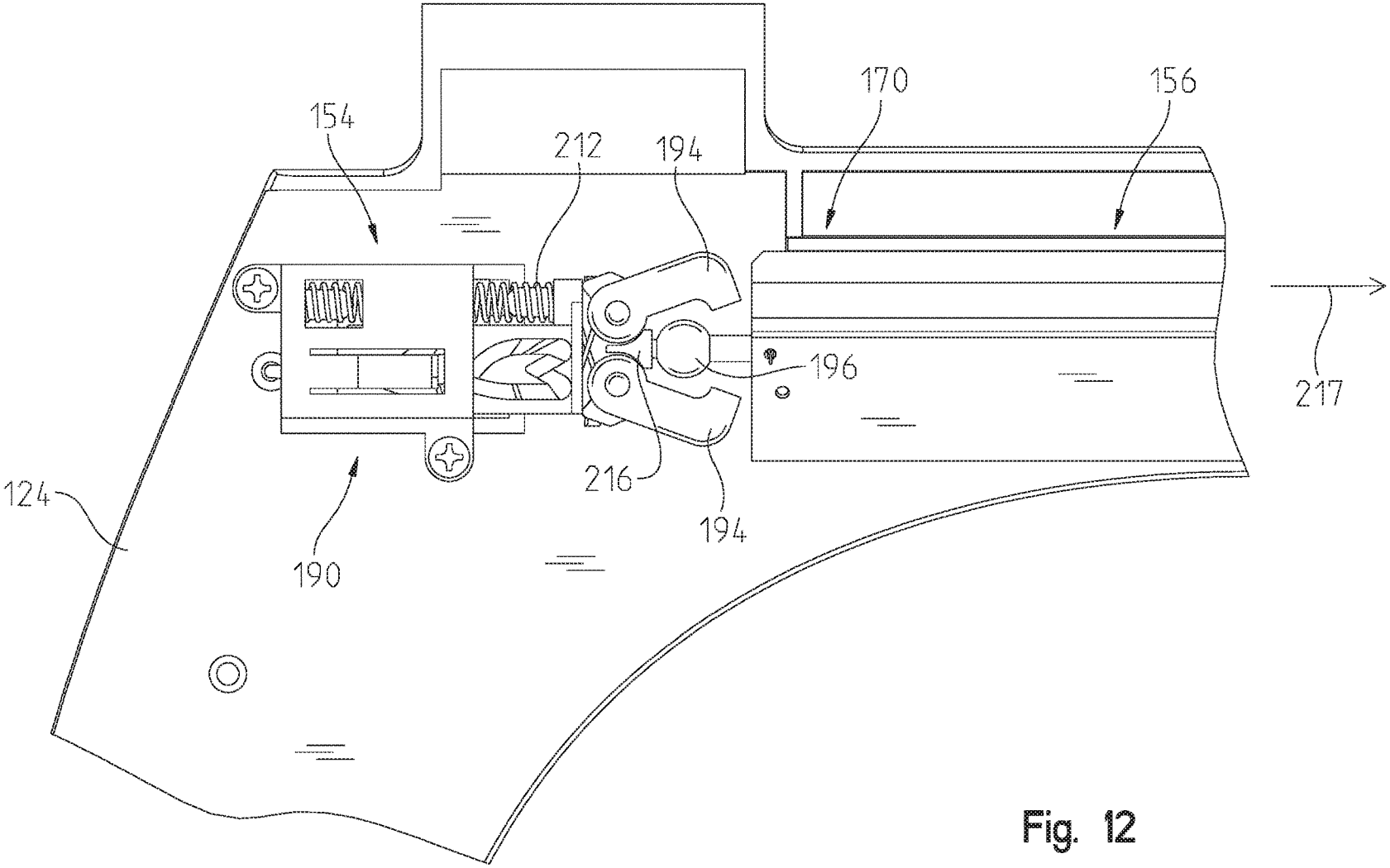
FIG. 12 is a top plan view of the night light module of FIG. 7, the night light module shown in a released position.
Figure 13:
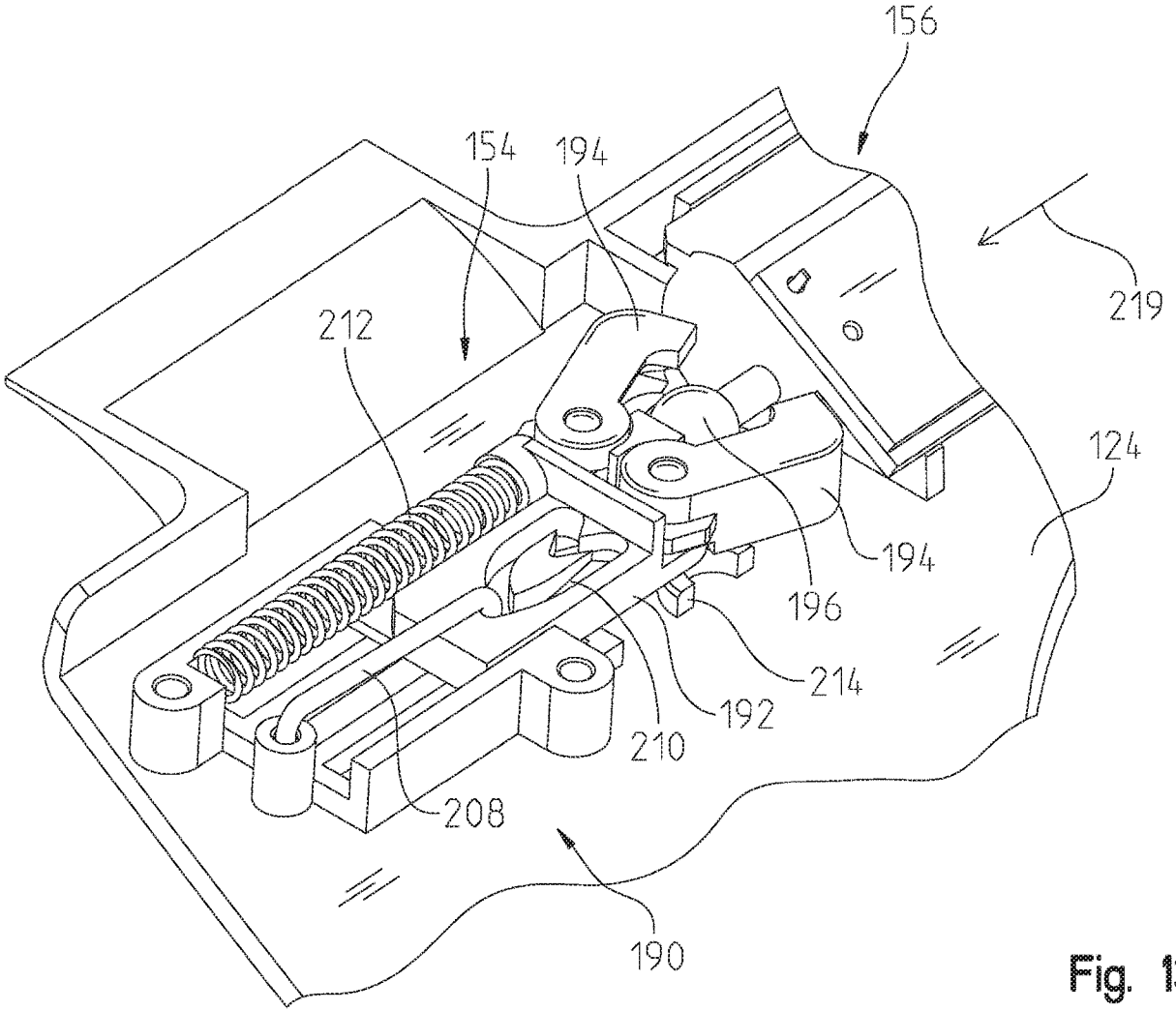
FIG. 13 is a partial perspective view of the night light module in the released position of FIG. 12, showing internal details of the coupler.

With reference to FIGS. 11-13, the push lock 190 illustratively includes a drive element or slide 192 configured to be depressed by the distal end 170 of the holder 156. Successive pressing (i.e., inwardly directed force as represented by arrow 193 in FIG. 7) of distal end 170 of the holder 156 into engagement with the push lock 190 will toggle the holder 156 between released and secured modes. The push lock 190 includes a pair of opposing arms 194 pivotably coupled to the slide 192 and configured to engage distal end 170 of the holder 156 in the secured mode. More particularly, the arms 194 are configured to engage an extension, illustratively a ball 196, extending from the distal end 170 of the holder 156. The opposing arms 194 are in spaced relation to the distal end 170 of the holder 156 in the released mode (FIGS. 12 and 13).

The drive element 192 of push lock 190 illustratively causes the opposing arms 194 to pivot inwardly and outwardly. A spring 198 biases the arms 194 outwardly such that holder 156 is in the released mode. The slide 192 is received between a base 202 and a cover 204. Conventional fasteners, such as screws 206, may secure the base 202 to the cover 204. A guide pin 208 rides within a track 210 formed within the slide 192 to define inner and outer positions of the slide 192. A spring 212 biases the slide 192 to the outer position. As the slide 192 moves inwardly, lips 193 on arms 194 engage bosses 214, thereby causing the arms 194 to move inwardly (FIG. 11). Bosses 214 are illustratively supported by the receiver 140 and may be integrally molded within an upper surface of bottom cover 124.

A tab 216 is supported on the proximal end of the slide 192 for engagement by the ball 196 of the holder 156. Successive depressing of the tab 216 causes the slide 192 to move inwardly and change operating positions as shown in FIGS. 12-17.

FIGS. 12 and 13 illustrate the holder 156 in the released position where the arms 194 of the push lock 190 are positioned in laterally spaced relation to the ball 196 at the distal end 170 of the holder 156. As such, the holder 156 may be moved axially outwardly (arrow 217 in FIG. 12) and removed from the receiver 140.

Figure 14:
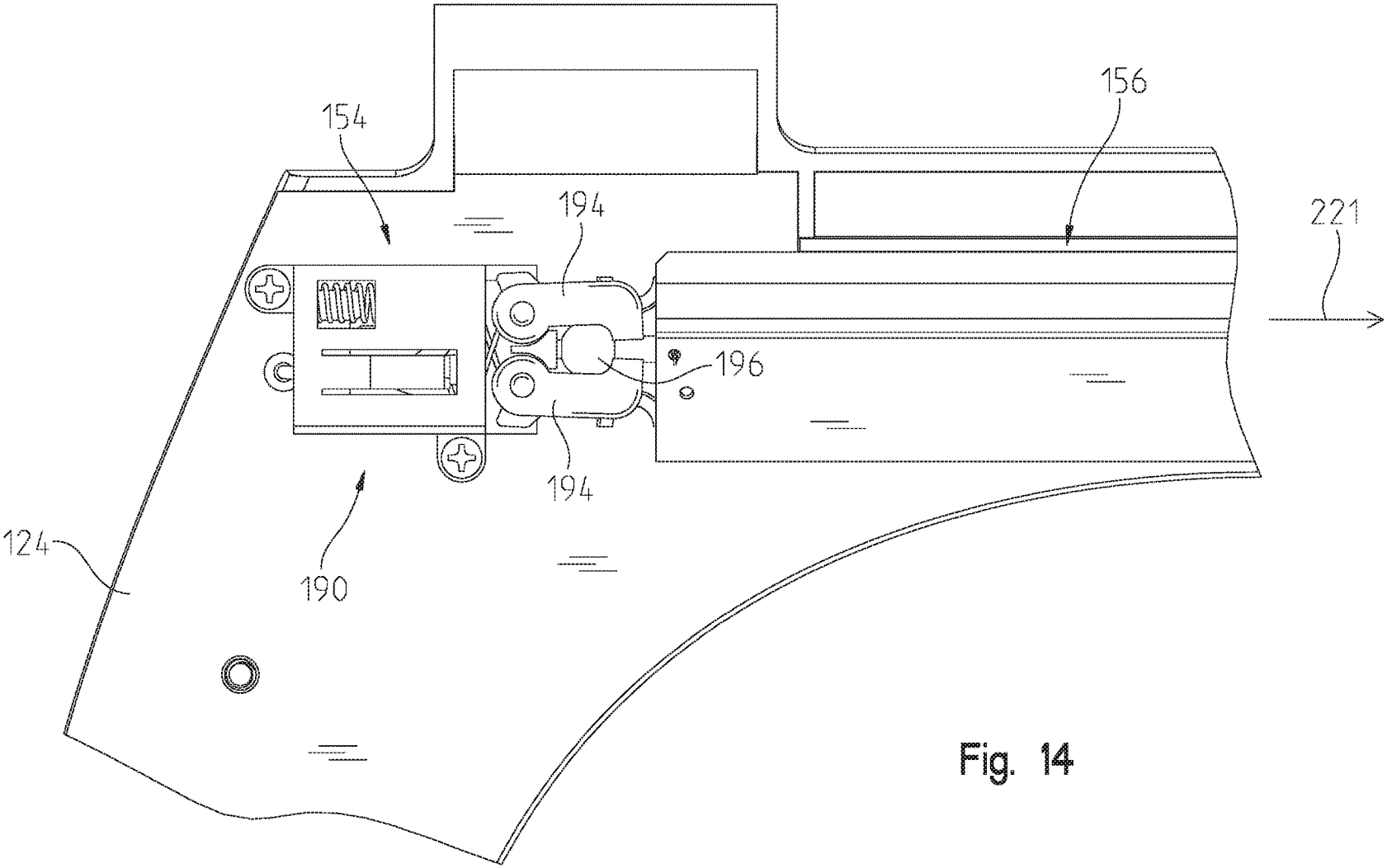
FIG. 14 is a top plan view of the night light module of FIG. 7, the night light module shown in an intermediate or limit position.
Figure 15:
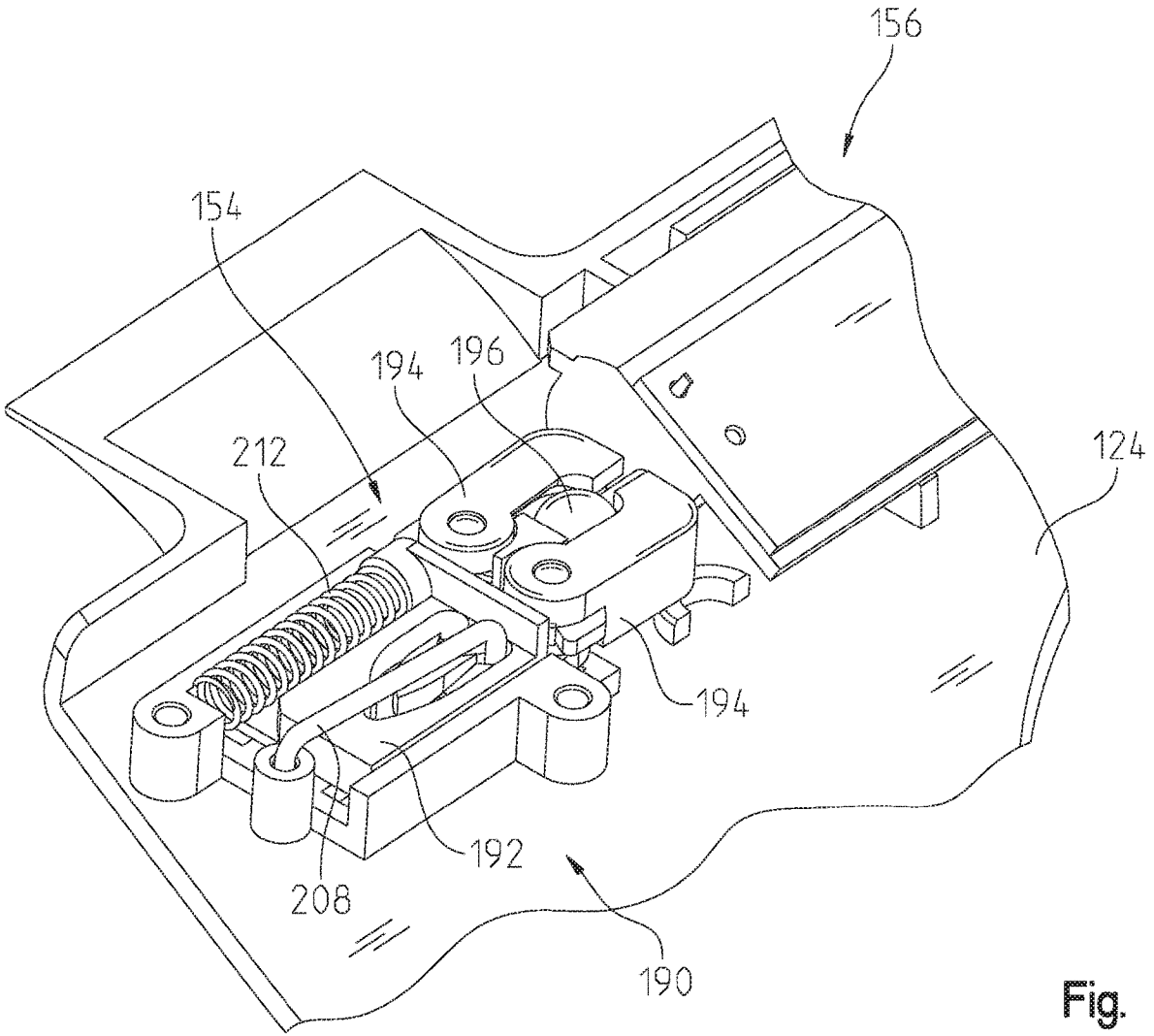
FIG. 15 is a partial perspective view of the night light module in the intermediate position of FIG. 14, showing internal details of the coupler.
Figure 16:
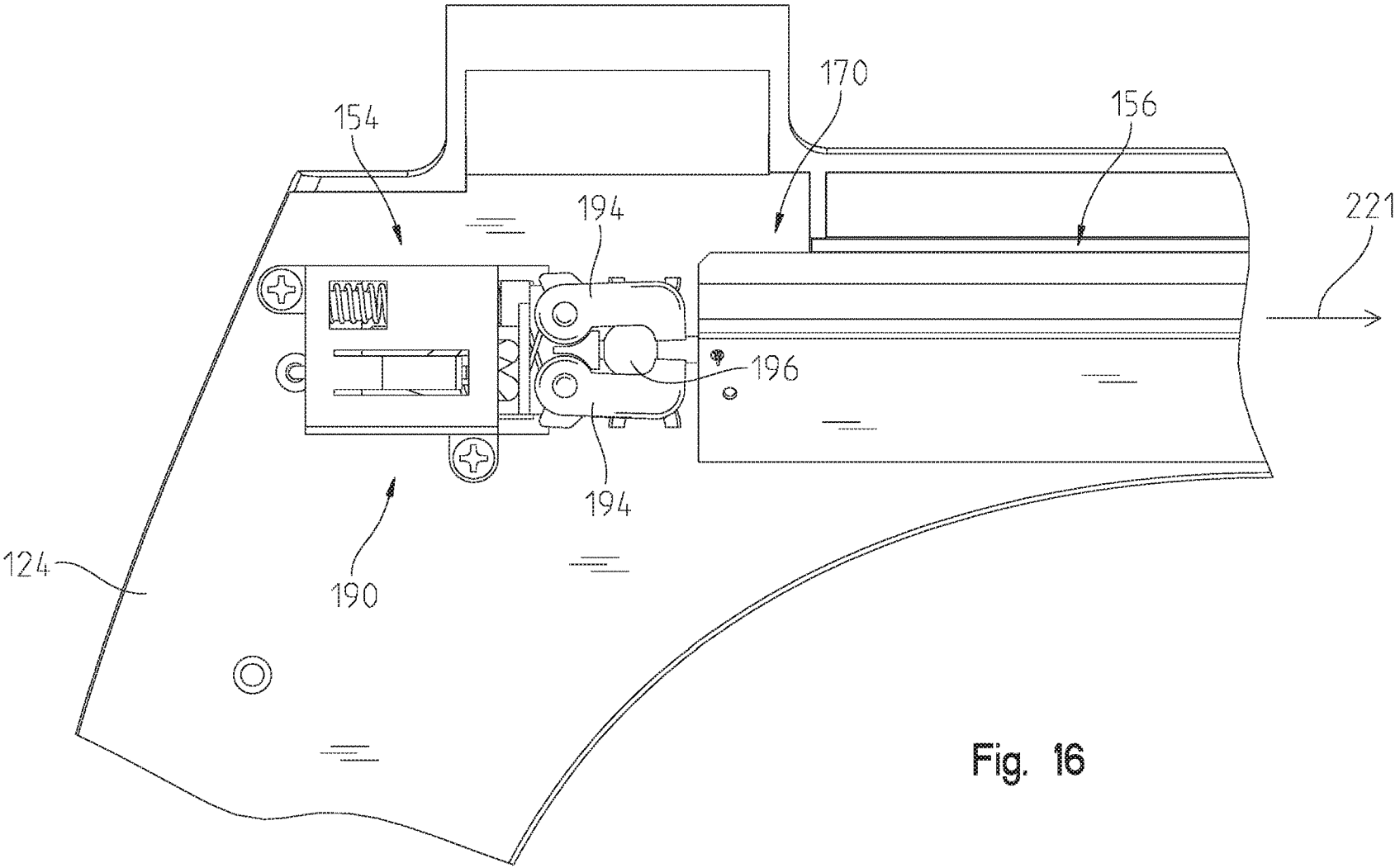
FIG. 16 is a top plan view of the night light module in a locked position.
Figure 17:
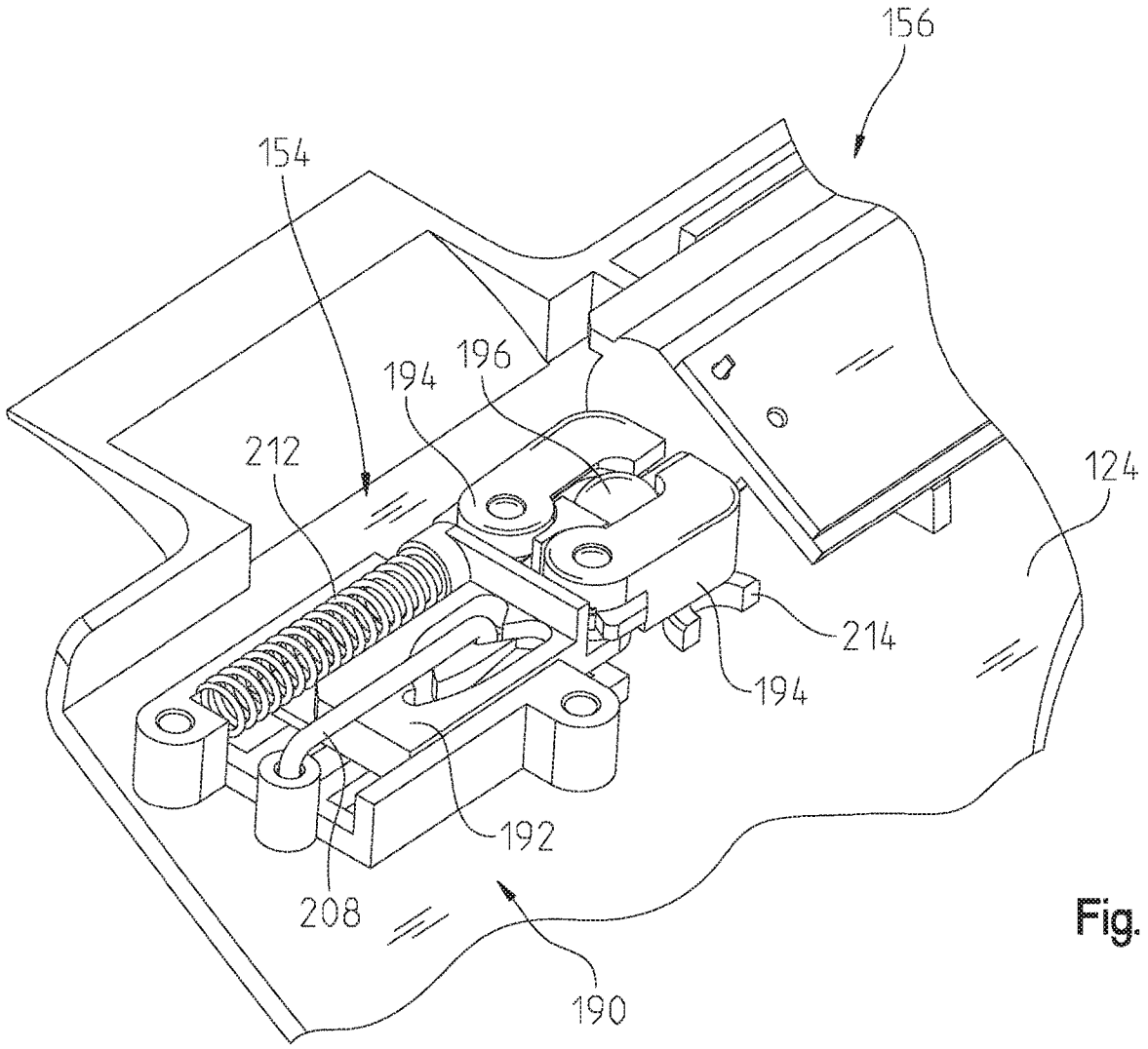
FIG. 17 is a partial perspective view of the night light module in the locked position of FIG. 16, showing internal details of the coupler.
Figure 18:
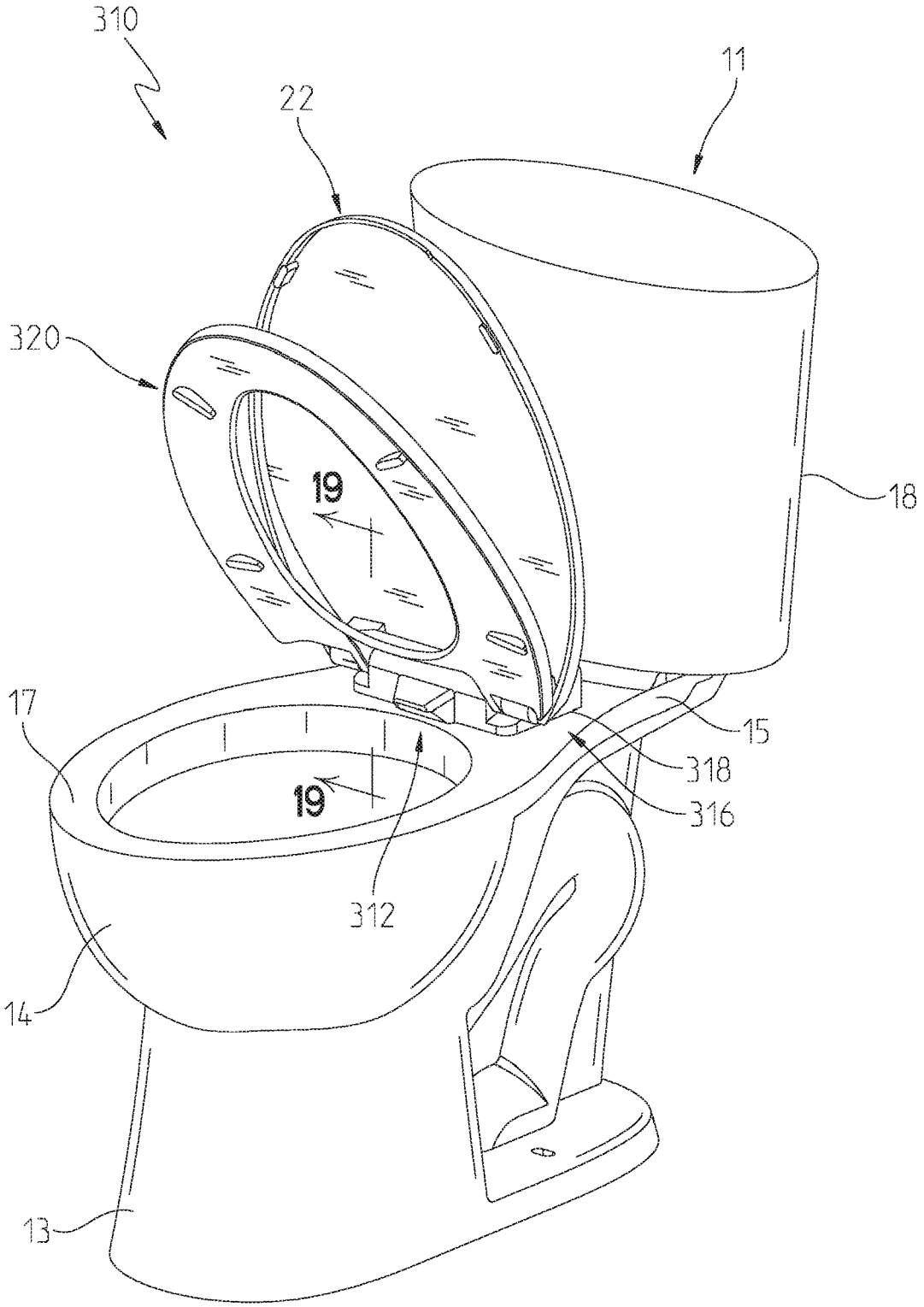
FIG. 18 is a perspective view of a toilet supporting a further illustrative toilet seat assembly, the toilet seat assembly including a night light.

FIGS. 14 and 15 illustrate the holder 156 in an intermediate position where the tab 216 of the slide 192 has been depressed by ball 196 (arrow 219 in FIG. 13). In operation, a user presses on the proximal end 168 of the holder 156 to cause the ball 196 to push on the slide 192. Upon releasing the holder 156, the push lock 190 transitions to the locked position of FIGS. 16 and 17. More particularly, the slide 192 is biased axially outwardly by the spring 212. As the slide 192 moves axially outwardly, the bosses 214 push the arms 194 laterally inwardly into locking engagement with the ball 196 to secure the distal end 170 of the holder 156 from outward axial movement (in the direction of arrow 221 in FIGS. 14 and 16). Subsequent pressing of the proximal end 168 of the holder 156 causes the push lock 190 to transition to the intermediate position, and releasing the holder 156 causes the push lock 190 to return to the unlocked position.

Operation of the night light 112 may be similar to that detailed above with respect to night light 12. For example, the night light 112 may be operated by a timer defined by controller 91 and activated in response to installation of the batteries 62.

Another illustrative embodiment night light assembly 312 for use with a toilet seat assembly 310 is shown in FIGS. 18-23. The night light 312 and toilet seat assembly 310 may include many of the same components identified above with night light 12 and toilet seat assembly 10. As such, similar components will be identified with like reference numbers.

Figure 19:
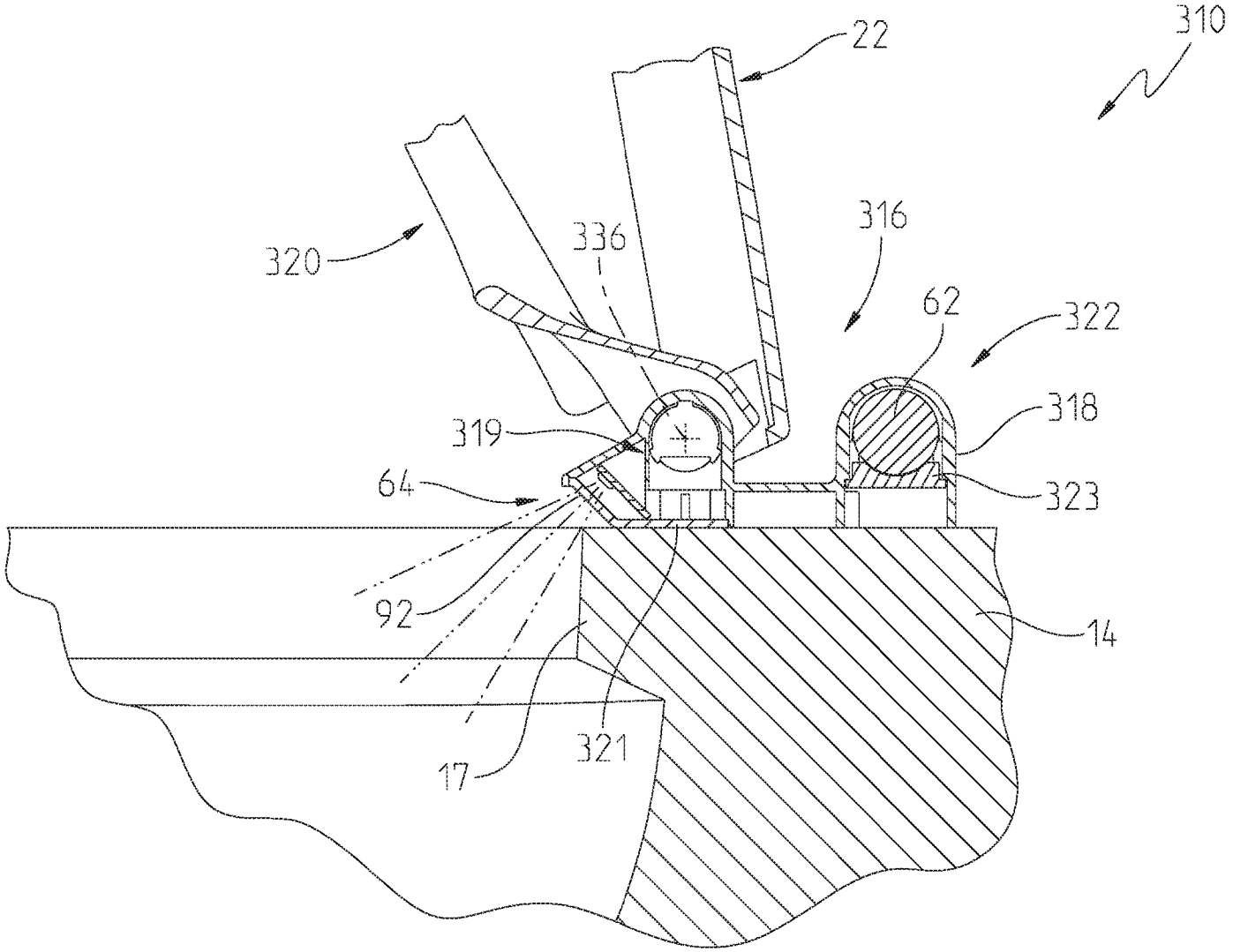
FIG. 19 is a cross-sectional view taken along line 19-19 of FIG. 18.
Figure 20:
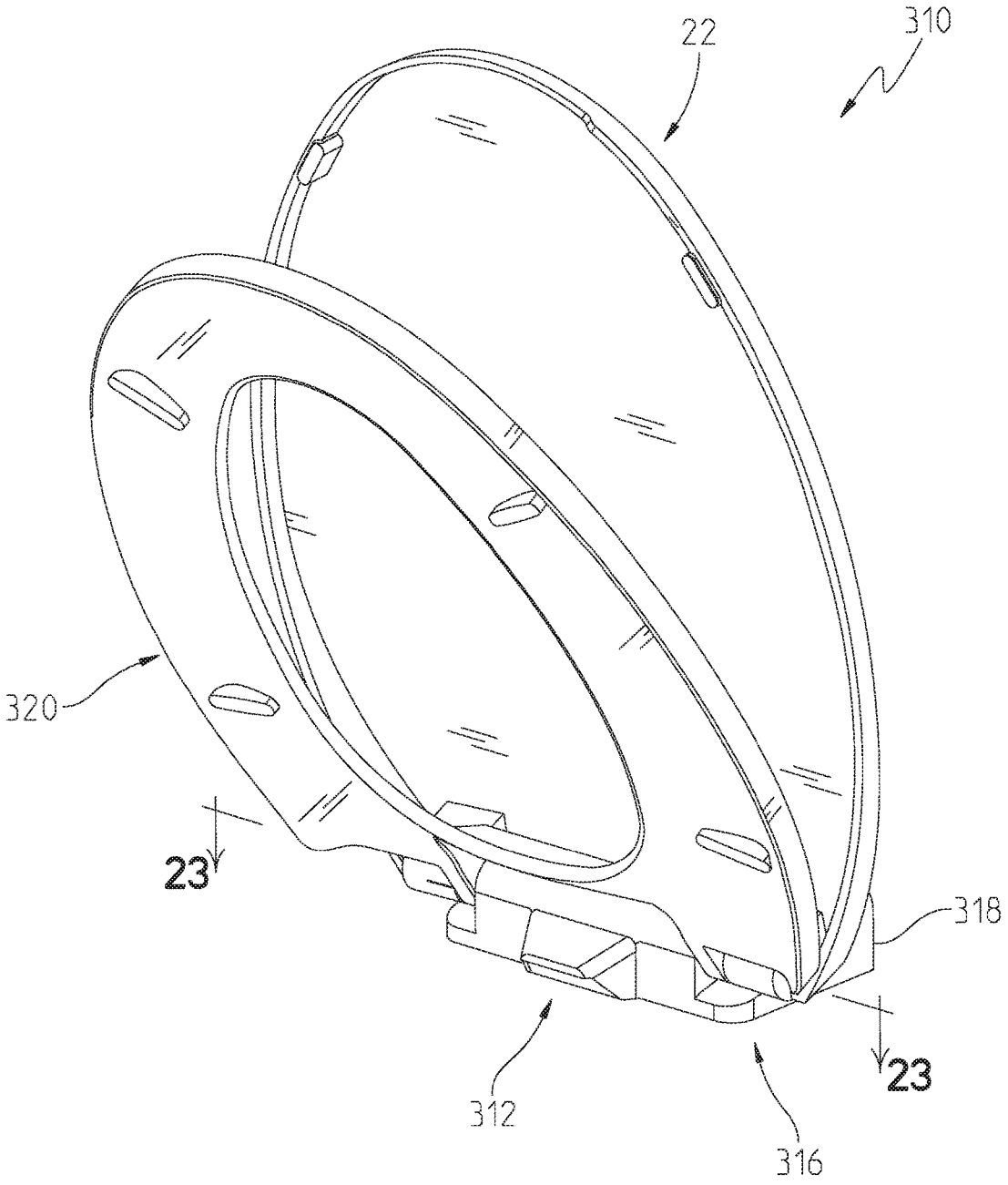
FIG. 20 is a perspective view of the toilet seat assembly of FIG. 18.
Figure 21:
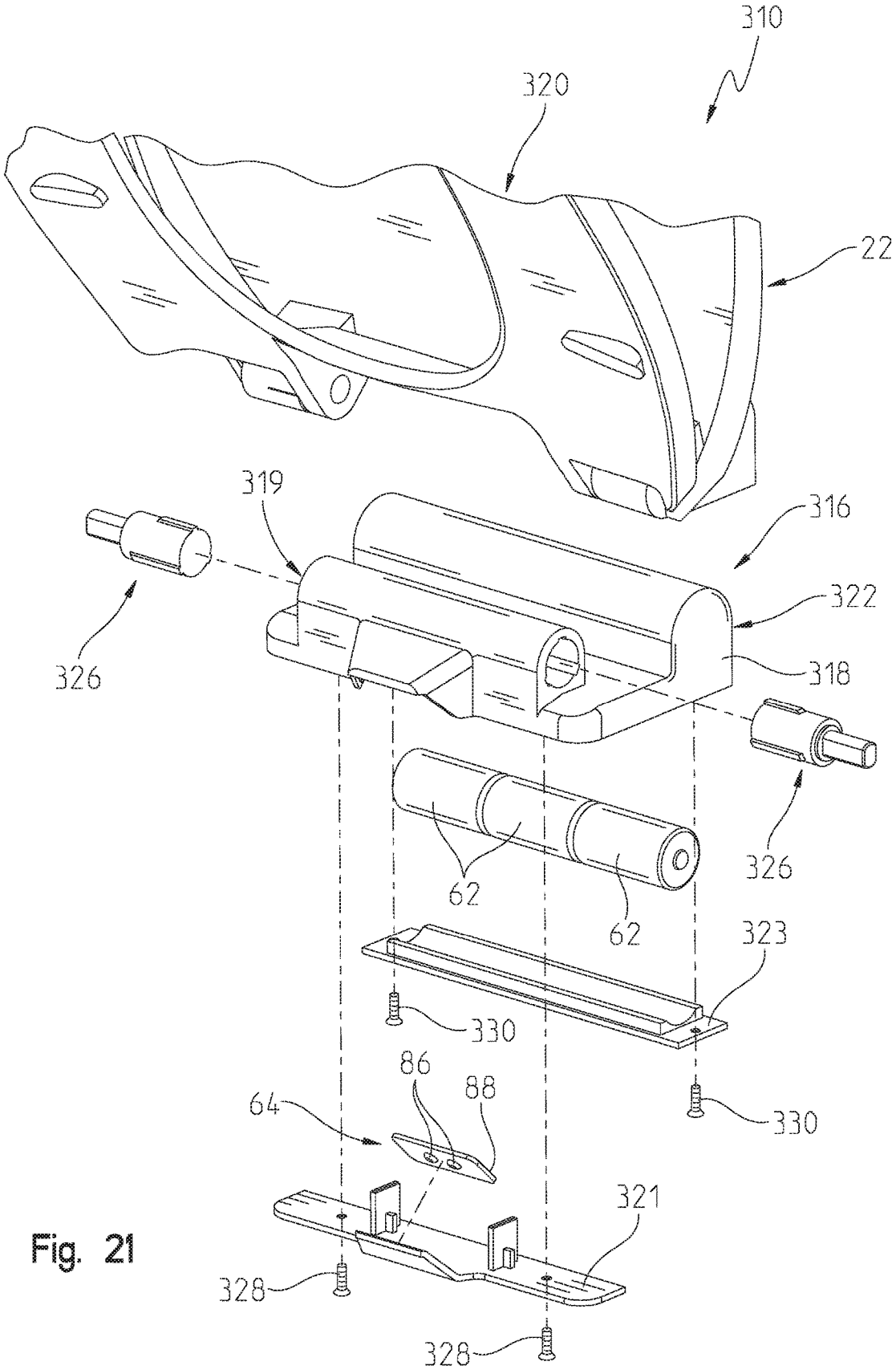
FIG. 21 is a partially exploded front perspective view of the toilet seat assembly of FIG. 18.
Figure 22:
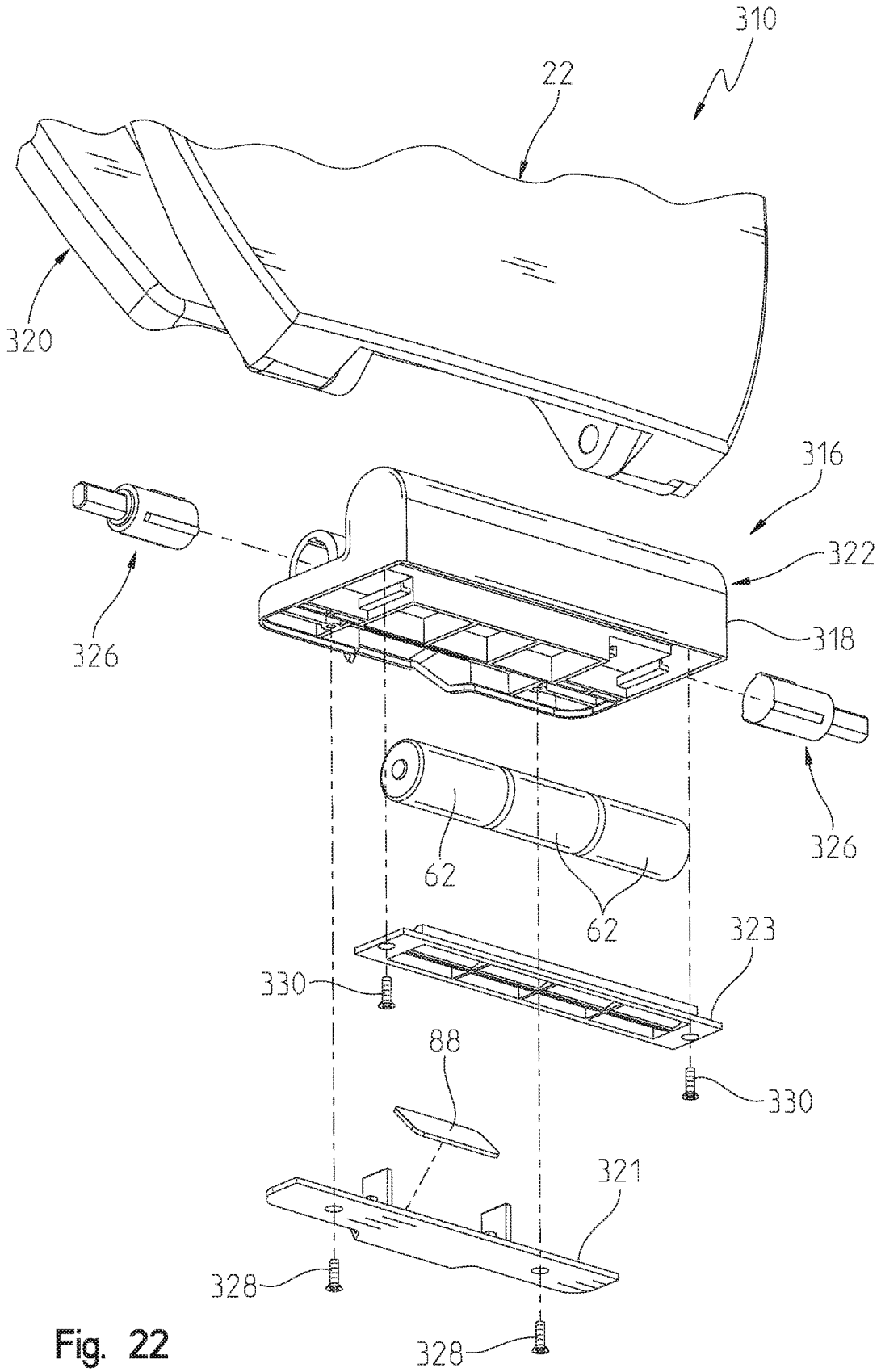
FIG. 22 is a partially exploded rear perspective view of the toilet seat assembly of FIG. 18.
Figure 23:
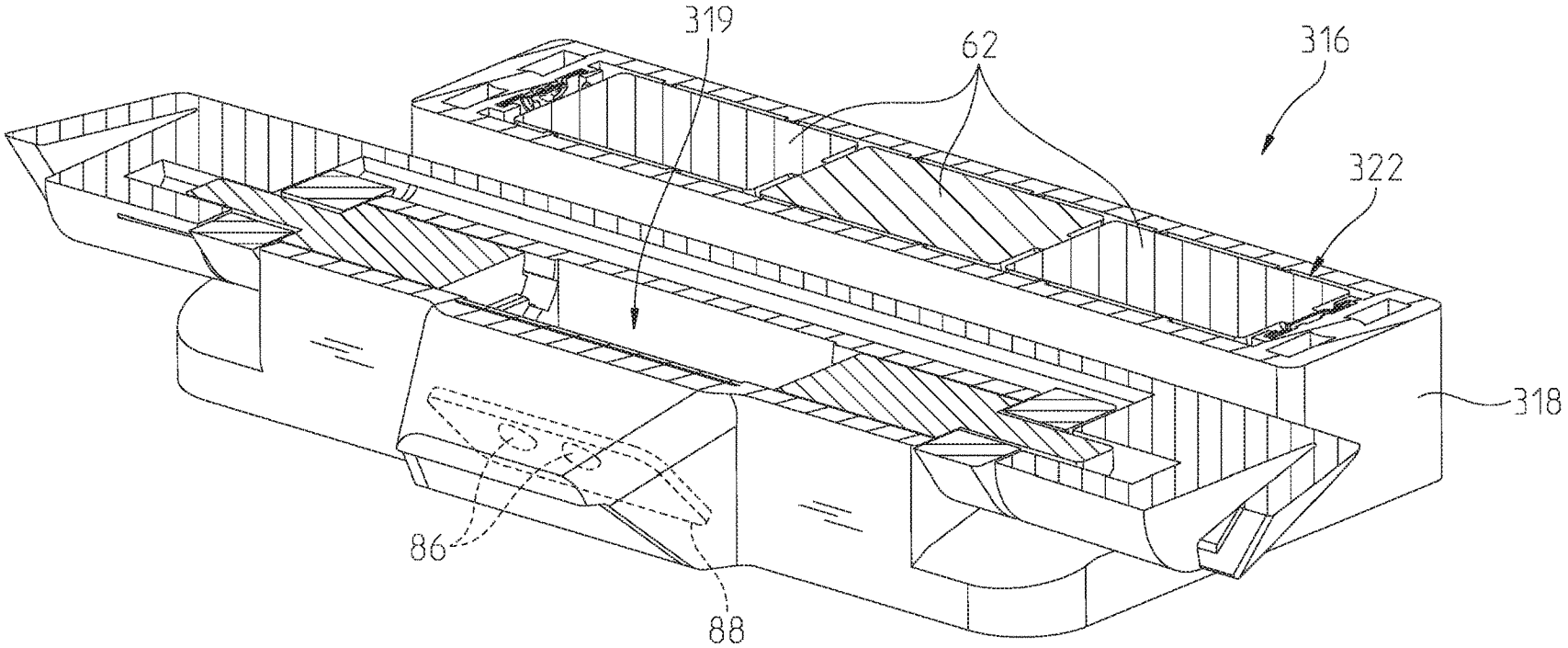
FIG. 23 is a cross-sectional view taken along line 23-23 of FIG. 20.
Figure 24:
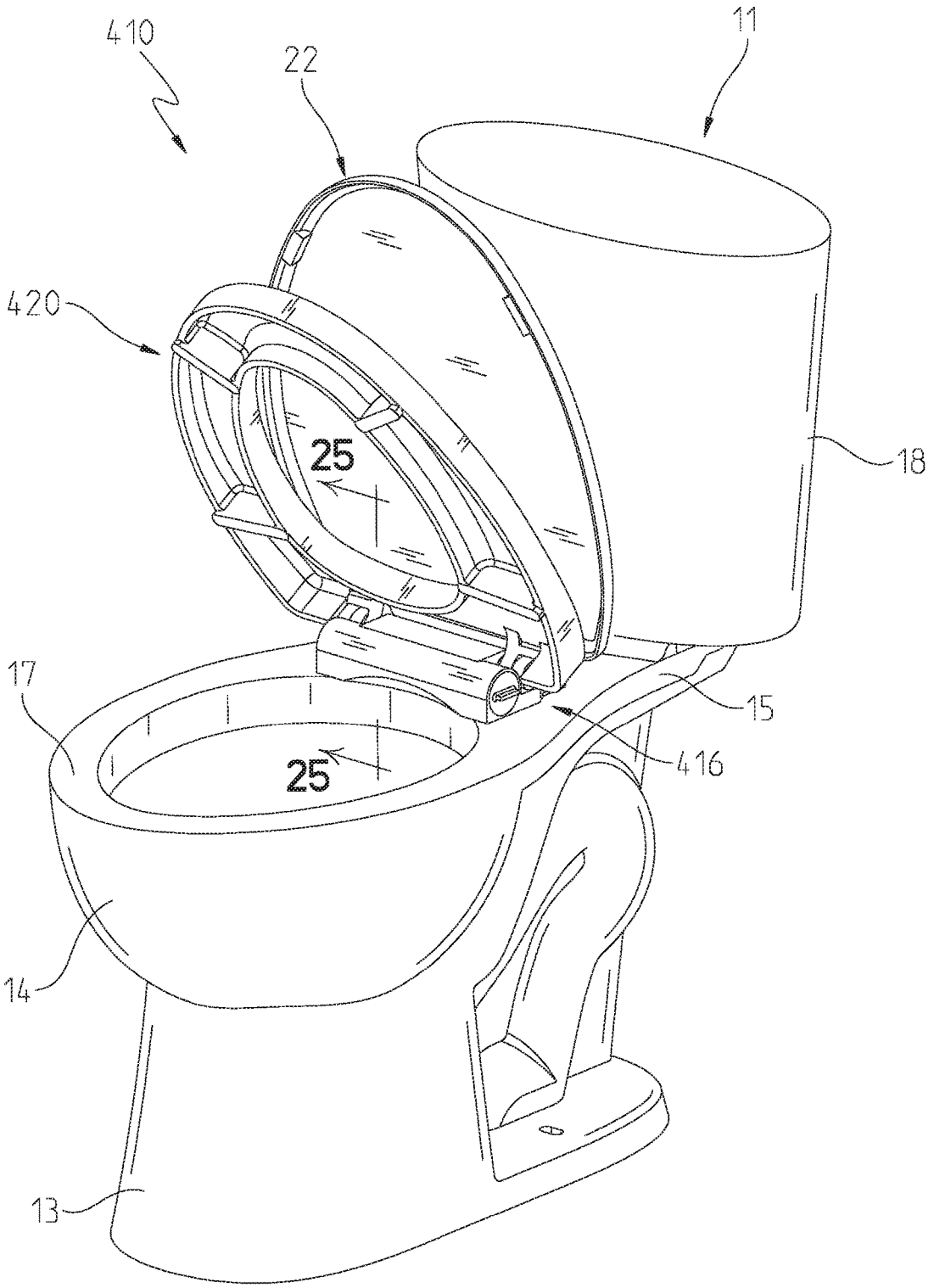
FIG. 24 is a perspective view of a toilet supporting a further illustrative toilet seat assembly, the toilet seat assembly including a night light.
Figure 25:
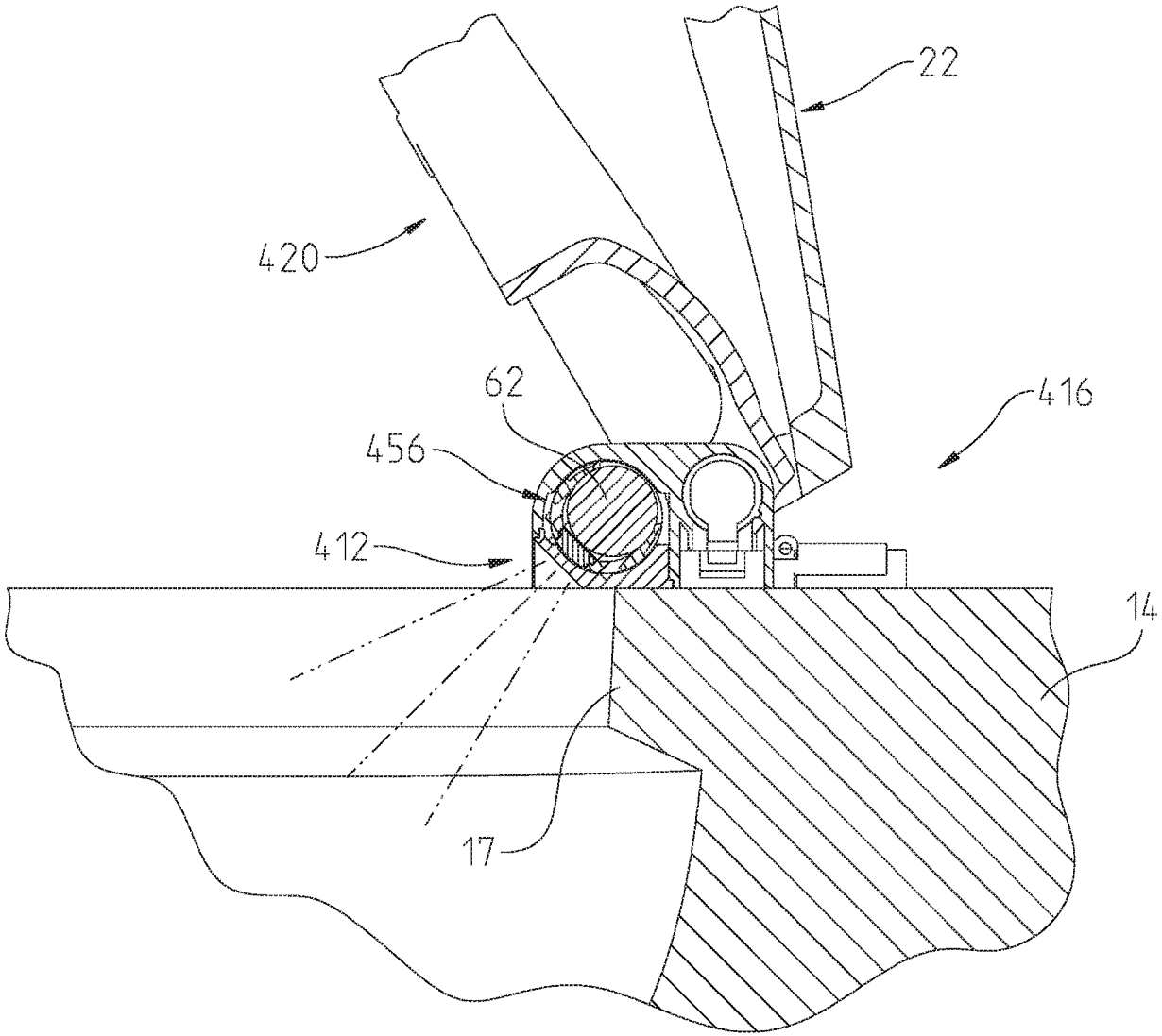
FIG. 25 is a cross-sectional view taken along line 25-25 of FIG. 24.
Figure 26:
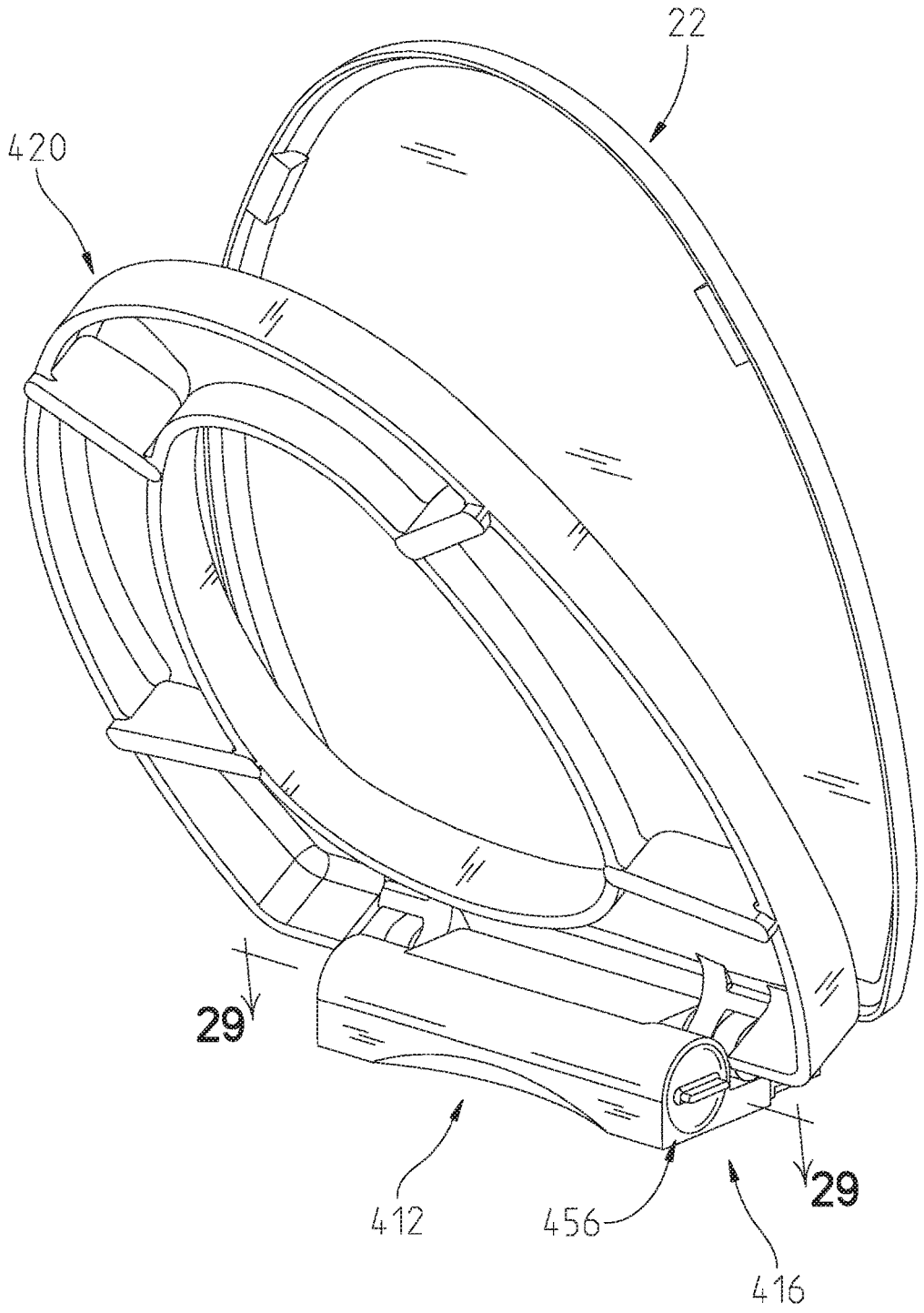
FIG. 26 is a perspective view of the toilet seat assembly of FIG. 24.
Figure 27:
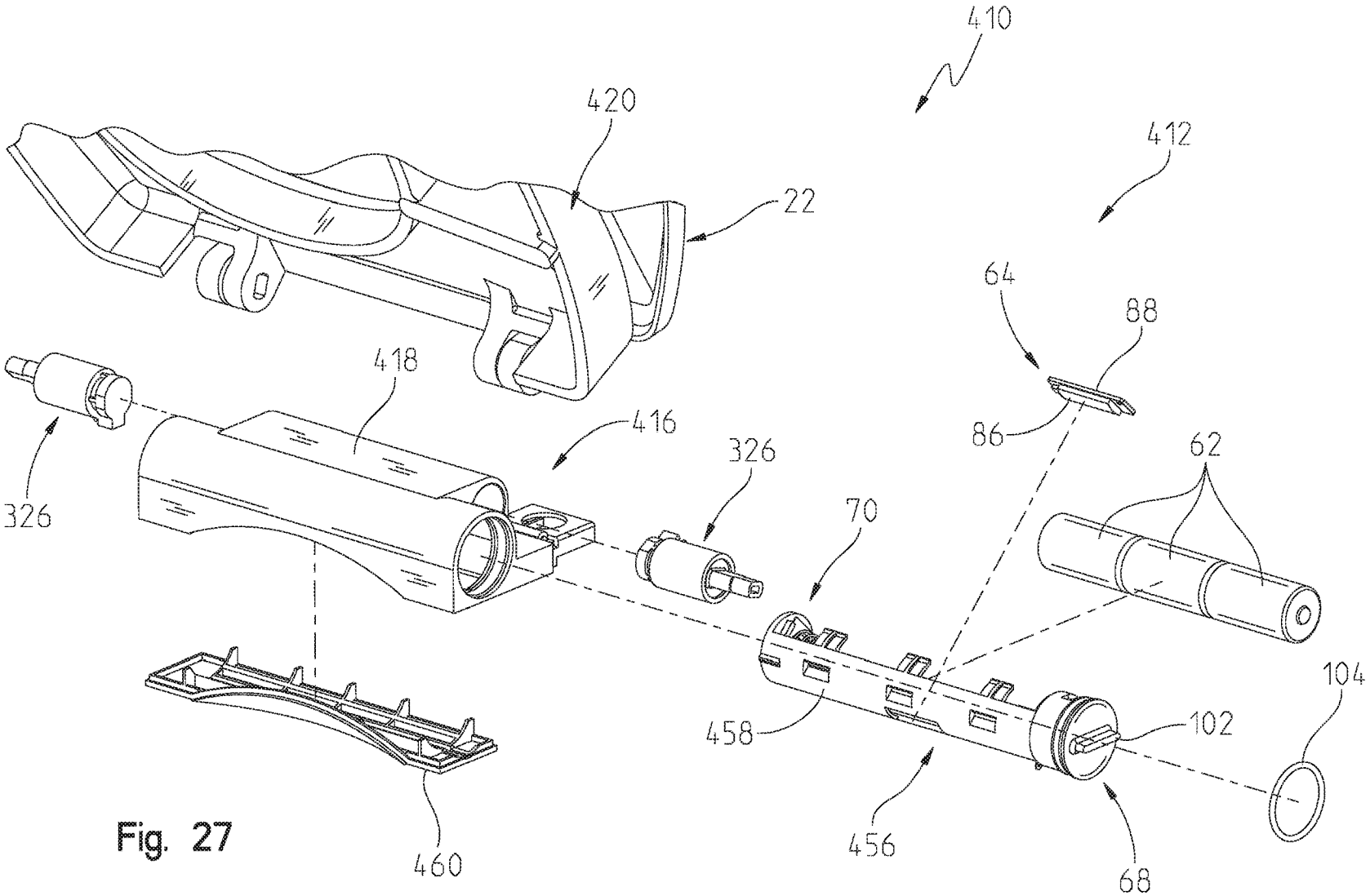
FIG. 27 is a partially exploded front perspective view of the toilet seat assembly of FIG. 24.
Figure 28:
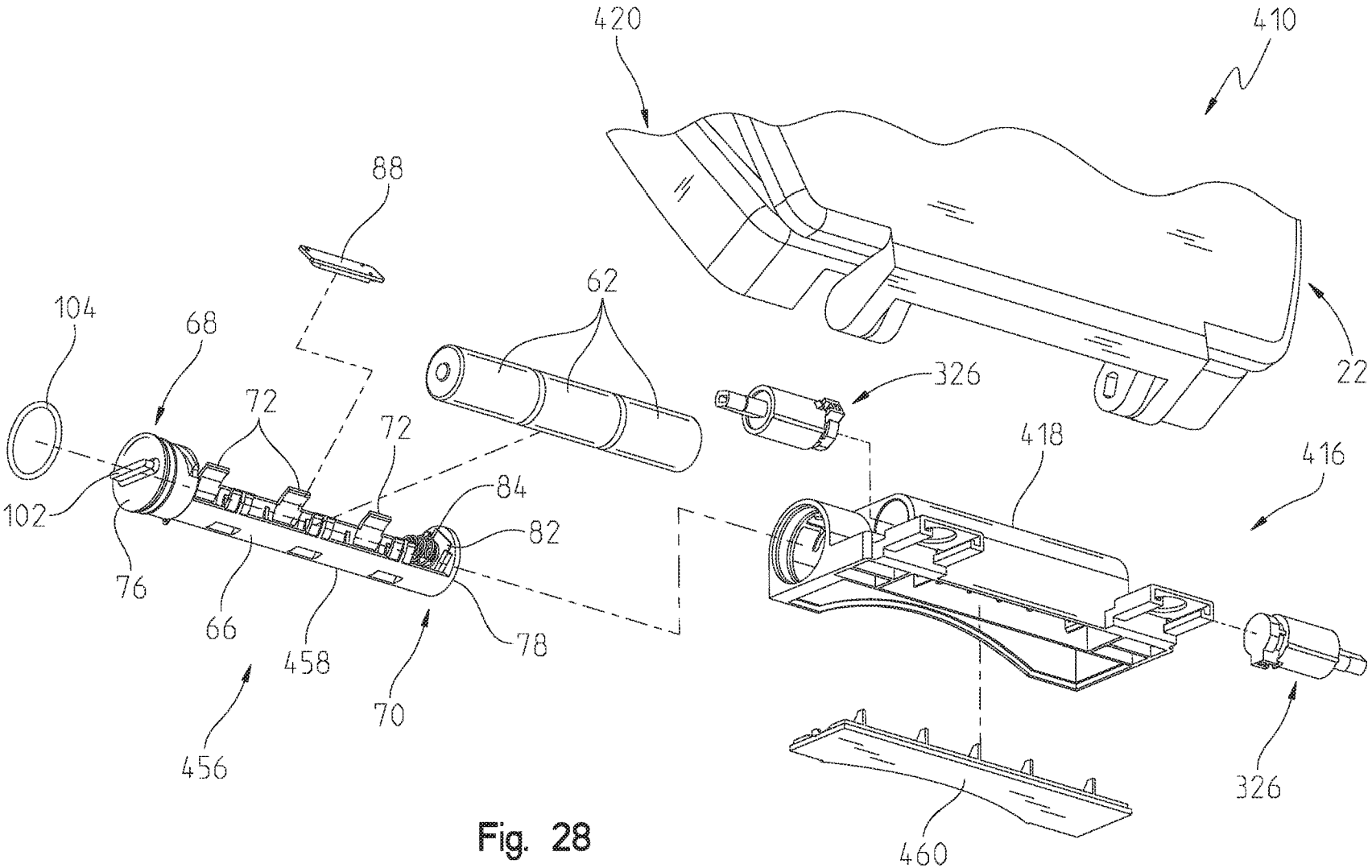
FIG. 28 is a partially exploded rear perspective view of the toilet seat assembly of FIG. 24.
Figure 29:
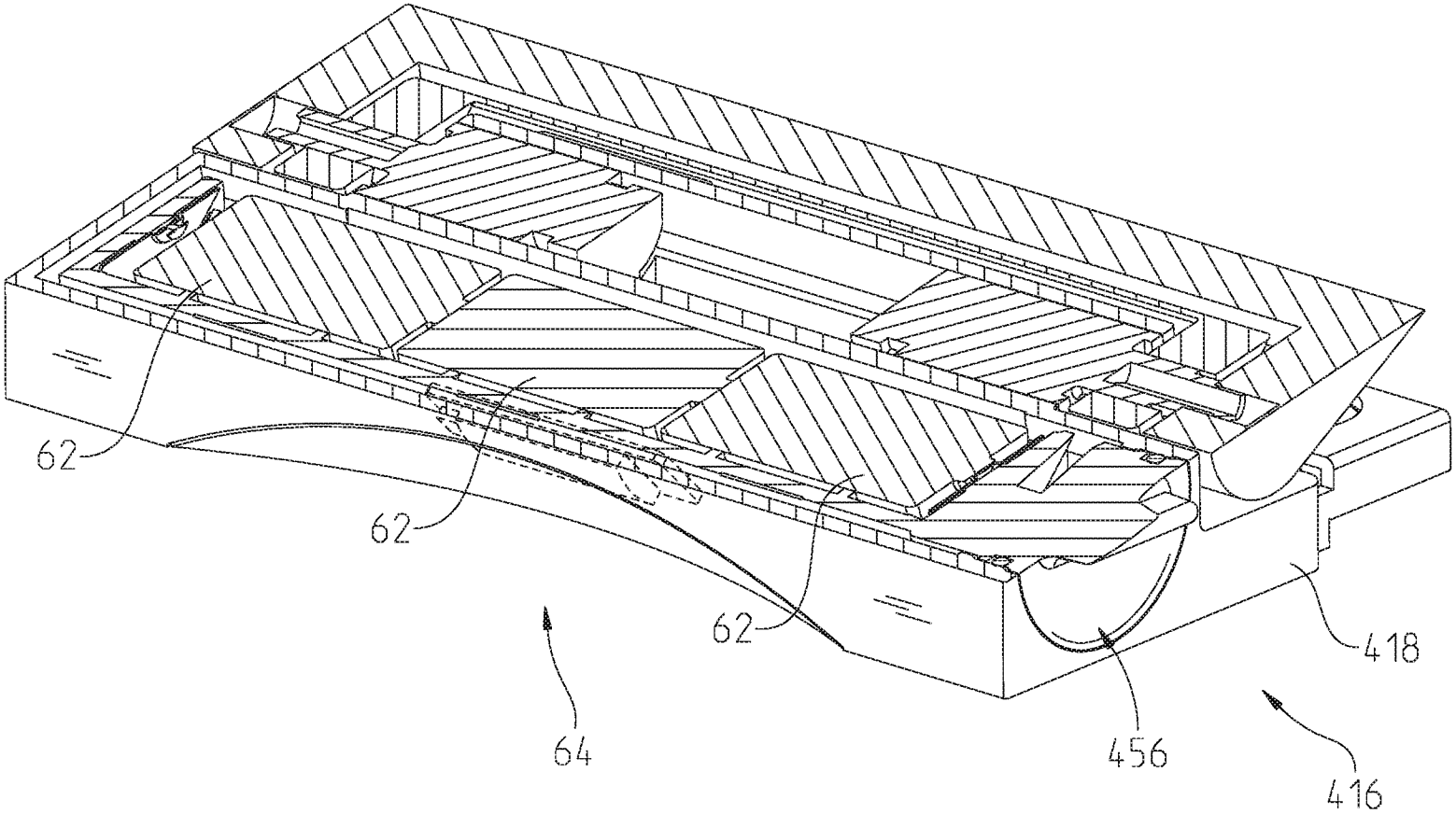
FIG. 29 is a cross-sectional view taken along line 29-29 of FIG. 26.

Hinge assembly 316 pivotably supports toilet seat 320 and includes a housing 318 defining a front chamber 319 positioned forward of the pivot axis 336 of the seat assembly 310, and a rear chamber 322 positioned rearwardly of the front chamber 319 (FIG. 19). Conventional slow close hinges 326 may be supported by the housing 318 and are operably coupled to the toilet seat 320.

The light source 64 is supported by a base 321 received within the front chamber 319 and is positioned to overhang the rim 17 of the toilet bowl 14 for directing light into the toilet bowl 14. Batteries 62 are supported by a holder 323 received within the rear chamber and are in electrical communication with the light source 64. Conventional fasteners, such as screws 328 and 330, may be used to secure the base 321 and the holder 232 to the housing 318.

In this illustrative embodiment, the light source 64 shines through translucent window 92 at the bottom of the hinge assembly 316 and is directed into the toilet bowl 14. Again, the seat 320 is shaped so as to not block light from the light source 64 when lowered. The batteries 62 are stored behind the hinge assembly 316 and are accessible by removing the seat 320 from the toilet bowl 14 and removing a battery cover, illustratively defined by the holder 323. Illustratively, a quick release seat attachment of conventional design (not shown) may be used to facilitate easy access to the batteries 62. The night light 312 may include a static electrical connection between the batteries 62 and the circuit board 88.

A further illustrative nightlight assembly 412 for use with toilet seat assembly 410 is shown in FIGS. 24-29. The night light 412 and toilet seat assembly 410 include many of the same components identified above with night light 12 and toilet seat assembly 10. As such, similar components will be identified with like reference numbers.

Hinge assembly 416 includes body 418 and pivotably supports toilet seat 420. In this illustrative embodiment, holder 456 slides into a side of the hinge assembly 416 and may be retained in a number of ways, such as the above-described coupler (e.g., cam lock 96). Additional attachment means may be utilized, including threads, snap fits, etc. The light source 64 shines through translucent window 92 in a base 460 of the hinge assembly 416 and is directed into the toilet bowl 14. The seat 420 is shaped so it does not block light from the light source 64 when in the lowered position.

The holder 456 is illustratively similar to the holder 56 detailed above. The holder 456 illustratively includes a body 458, such as a cylindrical sleeve, holding a plurality of batteries 62 (e.g., a plurality of c-cell batteries). Light source 64 is in electrical communication with the plurality of batteries 62, wherein a static electrical connection is provided between the batteries 62 and the circuit board 88. Mating features between the holder 456 and the hinge assembly 416 may locate the holder 456, so that the light source 64 is properly oriented towards the window 92 and the toilet bowl 14.

Illustrative embodiment night lights detailed herein are configured to provide substantially uniform toilet bowl illumination with sufficient brightness when the toilet seat is both raised and lowered. Illustrative embodiment night lights are also configured to provide battery holders that are easily accessible. For example, batteries in illustrative embodiment night lights detailed herein may be accessed without requiring disassembly of the toilet seat or other toilet components, and are not positioned in difficult to reach locations (such as under the toilet tank). Such illustrative battery holders are also positioned in "clean" areas of the toilet (e.g., access openings in the side of the toilet seat or hinge assembly).

As also detailed herein, illustrative embodiment night lights may include battery holders having integrated electronics and light sources for robust design (e.g., static electrical connections) and reduced cost. Such illustrative embodiment night lights are also configured to maintain easy to clean surfaces (e.g., molded cover within seat to reduce debris collecting seams, and side access of battery holder).

Although the invention has been described in detail with reference to certain preferred embodiments, variations and modifications exist within the spirit and scope of the invention as described and defined in the following claims.

The invention claimed is:

1. A light assembly for illuminating a toilet bowl, the light assembly comprising:

a toilet seat;

a hinge coupling the toilet seat to a toilet bowl for pivoting movement of the toilet seat about a pivot axis;

a receiving chamber supported by the hinge and defining a chamber axis extending parallel to the pivot axis between a proximal end and a distal end;

a holder received within the receiving chamber;

an access opening for the holder defined by the proximal end of the receiving chamber;

a plurality of batteries received within the holder;

a light source in electrical communication with the plurality of batteries;

a cover supported adjacent the light source; and a coupler supported at the distal end of the receiving chamber and releasably securing the holder within the receiving chamber in a secured mode, and the coupler permitting removal of the holder from the receiving chamber in a released mode.

2. The light assembly of claim 1, further comprising a circuit board in electrical communication with the batteries, wherein the light source comprises a light emitting diode coupled to the circuit board.

3. The light assembly of claim 2, wherein the circuit board is coupled to the holder, and the circuit board supports the light emitting diode in alignment with the cover to direct light toward the toilet bowl when the holder is in the secured mode.

4. The light assembly of claim 1, further comprising an o-ring supported at an end of the holder.

5. The light assembly of claim 1, wherein the coupler comprises a cam lock including a tab supported at a distal end of the holder and configured to engage with a wall supported within the receiving chamber, the tab rotatable from a first position wherein the holder is in the released mode to a second position where the holder is in the secured mode.

6. The light assembly of claim 5, further comprising a handle supported by the proximal end of the holder to facilitate user rotation of the holder.

7. The light assembly of claim 1, wherein the light source is positioned to overhang the rim of the toilet bowl.

8. The light assembly of claim 1, wherein the hinge includes a housing defining a front chamber positioned forward of the pivot axis, and a rear chamber positioned rearward of the front chamber.

9. The light assembly of claim 8, wherein the receiving chamber is defined by the rear chamber.

10. A light assembly for illuminating a toilet bowl, the light assembly comprising:

a toilet seat;

a hinge coupling the toilet seat to a toilet bowl for pivoting movement of the toilet seat about a pivot axis;

a receiving chamber supported by the hinge;

a holder received within the receiving chamber;

a plurality of batteries received within the holder;

a light source in electrical communication with the plurality of batteries;

a cover supported adjacent the light source;

a coupler releasably securing the holder within the receiving chamber in a secured mode, and the coupler permitting removal of the holder from the receiving chamber in a released mode;

wherein the coupler comprises a cam lock including a tab supported at a distal end of the holder and configured to engage with a wall supported within the receiving chamber, the tab rotatable from a first position wherein the holder is in the released mode to a second position where the holder is in the secured mode; and a handle supported by the proximal end of the holder to facilitate user rotation of the holder.

11. The light assembly of claim 10, further comprising a circuit board in electrical communication with the batteries, wherein the light source comprises a light emitting diode coupled to the circuit board.

12. The light assembly of claim 11, wherein the circuit board is coupled to the holder, and the circuit board supports the light emitting diode in alignment with the cover to direct light toward the toilet bowl when the holder is in the secured mode.

13. The light assembly of claim 10, further comprising an o-ring supported at an end of the holder.

14. The light assembly of claim 10, wherein the hinge includes a housing defining a front chamber positioned forward of the pivot axis, and a rear chamber positioned rearward of the front chamber.

15. The light assembly of claim 14, wherein the receiving chamber is defined by the rear chamber.

* * * * *